US011022933B2

(12) United States Patent
Hashimoto et al.

(10) Patent No.: US 11,022,933 B2
(45) Date of Patent: Jun. 1, 2021

(54) PROCESS CARTRIDGE, IMAGE FORMING APPARATUS AND CLEANING APPARATUS

(71) Applicant: CANON KABUSHIKI KAISHA, Tokyo (JP)

(72) Inventors: Kazunori Hashimoto, Numazu (JP); Katsuhiro Kojima, Mishima (JP); Toshiaki Takeuchi, Susono (JP); Yasukazu Ikami, Tokyo (JP); Kosuke Ikada, Machida (JP); Yoshihiro Mitsui, Mishima (JP); Yuichiro Hirata, Susono (JP); Go Shindo, Mishima (JP); Akinobu Saito, Yokohama (JP); Yuhei Terui, Numazu (JP); Noriyoshi Umeda, Sunto-gun (JP); Tomonori Matsunaga, Sunto-gun (JP); Shohei Kototani, Sunto-gun (JP); Masamichi Sato, Mishima (JP)

(73) Assignee: CANON KABUSHI KIKAISHA, Tokyo (JP)

( * ) Notice: Subject to any disclaimer, the term of this patent is extended or adjusted under 35 U.S.C. 154(b) by 0 days.

(21) Appl. No.: 16/874,833

(22) Filed: May 15, 2020

(65) Prior Publication Data

US 2020/0363768 A1 Nov. 19, 2020

(30) Foreign Application Priority Data

May 17, 2019 (JP) ..... JP2019-094056
Jan. 16, 2020 (JP) ..... JP2020-005444

(51) Int. Cl.
*G03G 21/16* (2006.01)
*G03G 21/00* (2006.01)

(52) U.S. Cl.
CPC ..... *G03G 21/1647* (2013.01); *G03G 21/0005* (2013.01)

(58) Field of Classification Search
CPC ..... G03G 21/1647; G03G 21/0005
See application file for complete search history.

(56) References Cited

U.S. PATENT DOCUMENTS 5,671,476 A * 9/1997 Ishiguro ..... G03G 21/0035 399/354
5,879,847 A * 3/1999 Yoshinaga ..... G03G 5/0578 399/111

(Continued)

FOREIGN PATENT DOCUMENTS

EP 2040130 A1 3/2009
JP S5871762 U 5/1983

(Continued)

*Primary Examiner* — Francis C Gray
(74) *Attorney, Agent, or Firm* — Rossi, Kimms & McDowell LLP

(57) ABSTRACT

A process cartridge includes a seal member contacting an image bearing member upstream in the rotation direction of the image bearing member from a cleaning member and allowing the developer to move from upstream in the rotation direction from the contact part between the seal member and the image bearing to downstream from the contact part while regulating movement from downstream to upstream from the contact part. The developer has surface protrusions containing an organic silicon polymer, wherein either (i) the work function of the seal member is greater than the work function of the developer when the developer has a negative charging polarity and is smaller than the work function of the developer when the developer has a positive charging polarity, or (ii) the absolute value of the difference between the work function of the seal member and the work function of the developer is within a predetermined range.

39 Claims, 15 Drawing Sheets

(56) References Cited

U.S. PATENT DOCUMENTS

| | | | | |
|---|---|---|---|---|
| 6,376,695 | B1 * | 4/2002 | Kushibiki | C07F 7/1804<br>556/413 |
| 2017/0329246 | A1 * | 11/2017 | Yamawaki | G03G 9/0821 |
| 2017/0336727 | A1 * | 11/2017 | Ikejiri | G03G 9/0821 |

FOREIGN PATENT DOCUMENTS

| | | | |
|---|---|---|---|
| JP | H04245285 | A | 9/1992 |
| JP | 2016011972 | A | 1/2016 |
| WO | 2008001463 | A1 | 1/2008 |

* cited by examiner

PROCESS CARTRIDGE, IMAGE FORMING APPARATUS AND CLEANING APPARATUS

BACKGROUND OF THE INVENTION

Field of the Invention

The present invention relates to a process cartridge having a cleaning member for removing developer remaining on an electrophotographic photosensitive member after a developer image has been transferred from the electrophotographic photosensitive member to a recording medium or intermediate transfer member, and to an image forming apparatus and a cleaning apparatus.

Description of the Related Art

Conventionally, as described in Japanese Unexamined Utility Model Application Publication No. S58-71762, a seal sheet made of thermoplastic urethane has been known as a suitable seal member for an apparatus for cleaning developer from an electrophotographic photosensitive drum (hereunder, a photosensitive drum) used as an image bearing member of an image forming apparatus.

SUMMARY OF THE INVENTION

However, in recent years image forming apparatuses have tended towards smaller size, higher speed, greater energy efficiency and higher image quality. When an image forming apparatus is made smaller, the size of the photosensitive drum is also reduced. When the speed is increased, the photosensitive drum rotates more rapidly. This means that a cleaning blade (cleaning member) in contact with the photosensitive drum slides against the surface of the photosensitive drum at high speed. The temperature of the cleaning blade itself rises as a result, and the cleaning blade becomes softer, thereby increasing the contact surface between the cleaning blade and the photosensitive drum so that the frictional force between the photosensitive drum surface and the cleaning blade is increased. The drive torque for driving the photosensitive drum increases as a result. This leads to increased power consumption, detracting from energy efficiency.

It is an object of the present invention to provide a process cartridge, an image forming apparatus and a cleaning apparatus whereby an increase in the drive torque for driving an image bearing member can be controlled.

To achieve this object, the process cartridge used in the image forming apparatus of the present invention comprises the following:

a rotatable image bearing member having a peripheral surface whereon a latent image is formed, a developing apparatus that supplies a developer to the image bearing member to develop the latent image, a cleaning member that comes into contact with the peripheral surface and removes the developer from the peripheral surface, and a seal member that comes into contact with the peripheral surface at a contact part between the seal member and the peripheral surface on an upstream side of the cleaning member in the rotation direction of the image bearing member, and that allows developer to move from an upstream side of the contact part to a downstream side of the contact part in the rotation direction while regulating movement of the developer from the downstream side of the contact part to the upstream side of the contact part in the rotation direction;

wherein the developer includes a toner having a toner particle containing a toner base particle and an organosilicon polymer on the toner base particle surface, the organosilicon polymer has a structure represented by formula (1) below, and the organosilicon polymer forms protrusions on the toner base particle surface, and wherein either (i) the work function of the seal member, is greater than the work function of the developer when the developer has a negative charging polarity, and is smaller than the work function of the developer when the developer has a positive charging polarity, or (ii) the absolute value of the difference between the work function of the seal member and the work function of the developer is within a predetermined range;

$$R—SiO_{3/2} \quad (1)$$

in the formula, R is a $C_{1-6}$ alkyl group or phenyl group.

To achieve this object, the image forming apparatus of the present invention comprises the following:

a main body; and the process cartridge of the present invention, the process cartridge being detachable from the main body.

To achieve this object, the image forming apparatus for forming images on a recording material of the present invention comprises the following:

a rotatable image bearing member having a peripheral surface whereon a latent image is formed, a developing apparatus that supplies a developer to the image bearing member to develop the latent image, a cleaning member that comes into contact with the peripheral surface and removes the developer from the peripheral surface, a seal member that comes into contact with the peripheral surface at a contact part between the seal member and the peripheral surface on an upstream side of the cleaning member in the rotation direction of the image bearing member, and that allows developer to move from an upstream side of the contact part to a downstream side of the contact part in the rotation direction while regulating movement of the developer from the downstream side of the contact part to the upstream side of the contact part in the rotation direction, and an voltage application means for applying voltage to the seal member, wherein the developer includes a toner having a toner particle containing a toner base particle and an organosilicon polymer on the toner base particle surface, the organosilicon polymer has a structure represented by formula (1) below, and the organosilicon polymer forms protrusions on the toner base particle surface, and wherein the seal member is a member having electrical conductivity, and wherein the voltage application means applies voltage having a polarity opposite to the normal charging polarity of the toner;

$$R—SiO_{3/2} \quad (1)$$

in the formula, R is a $C_{1-6}$ alkyl group or phenyl group.

To achieve this object, the cleaning apparatus of the present invention comprises the following:

a frame, an image bearing member that is rotatably supported by the frame and carries a developer image consisting of a developer, and a cleaning member that is provided on the frame and that cleans developer remaining on the surface of the image bearing member after the developer image has been transferred from the image bearing member, and that has a contact portion capable of coming into contact with the surface of the image bearing member, wherein during use, an intervening particle is present in an adjacent region, which is located on an upstream side of a contact area between the contact portion and the image bearing member, and which is adjacent to the contact area, in the rotation direction of the image bearing member, wherein the intervening particle is a composite particle having a first particle which contains a base particle and an organosilicon polymer on the surface of the base particle, and wherein the organosilicon polymer has a structure represented by formula (1) below, and wherein the organosilicon polymer forms protrusions on the toner base particle surface, and wherein, in a flat image obtained by observing a cross-section of the composite particle with a scanning transmission electron microscope STEM, drawing a line along the circumference of the base particle surface, and converting based on this line along the circumference, and assuming that the length of the line along the circumference for a segment where a protrusion and the toner base particle form a continuous interface is taken as a protrusion width w, the maximum length of a protrusion in the direction normal to the protrusion width w is taken as a protrusion diameter d, and the length, in the line segment that forms the protrusion diameter d, from the peak of the protrusion to the line along the circumference is taken as a protrusion height h, the numerical proportion P(d/w), in protrusions having a protrusion height h from 40 nm to 300 nm, of protrusions having a ratio d/w of protrusion diameter d to protrusion width w from 0.33 to 0.80 is at least 70 number %, and wherein the protrusion is transported from the surface of the base particle to the contact area by the rotation of the image bearing member;

$$R—SiO_{3/2} \quad (1)$$

in the formula, R is a $C_{1-6}$ alkyl group or phenyl group.

To achieve this object, the process cartridge of the present invention comprises the following:

a frame, an image bearing member that is rotatably supported by the frame and carries a developer image consisting of a developer, a developer carrying member that supplies developer to the image bearing member so that a latent image formed on the image bearing member is developed into the developer image, and a cleaning member provided on the frame that cleans developer remaining on the surface of the image bearing member after the developer image has been transferred from the image bearing member, and that has a contact portion capable of coming into contact with the surface of the image bearing member, wherein during use, an intervening particle is present in an adjacent region, which is located on an upstream side of a contact area between the contact portion and the image bearing member, and which is adjacent to the contact area, in the rotation direction of the image bearing member, and wherein the intervening particle is a composite particle having a first particle which contains a base particle and an organosilicon polymer on the surface of the base particle, and wherein the organosilicon polymer has a structure represented by formula (1) below, and wherein the organosilicon polymer forms protrusions on the toner base particle surface, and wherein, in a flat image obtained by observing a cross-section of the composite particle with a scanning transmission electron microscope STEM, drawing a line along the circumference of the base particle surface and converting based on this line along the circumference, and assuming that the length of the line along the circumference for a segment where a protrusion and the toner base particle from a continuous interface is taken as a protrusion width w, the maximum length of a protrusion in the direction normal to the protrusion width w is taken as a protrusion diameter d, and the length, in the line segment that forms the protrusion diameter d, from the peak of the protrusion to the line along the circumference is taken as a protrusion height h, and wherein, the numerical proportion P (d/w), in protrusions having a protrusion height h from 40 nm to 300 nm, of protrusions having a ratio d/w of protrusion diameter d to protrusion width w from 0.33 to 0.80 is at least 70 number %, and wherein the protrusion is transported from the surface of the base particle to the contact area by the rotation of the image bearing member rotates;

$$R—SiO_{3/2} \quad (1)$$

in the formula, R is a $C_{1-6}$ alkyl group or phenyl group.

To achieve this object, the image forming apparatus of the present invention comprises the following:

a frame, an image bearing member that is rotatably supported by the frame and carries a developer image consisting of a developer, and a cleaning member that is provided on the frame and that cleans developer remaining on the surface of the image bearing member after the developer image has been transferred from the image bearing member, and that has a contact portion capable of coming into contact with the surface of the image bearing member, wherein during use, an intervening particle is present in an adjacent region, which is located on an upstream side of a contact area between the contact portion and the image bearing member, and which is adjacent to the contact area, in the rotation direction of the image bearing member, wherein the intervening particle is a composite particle having a first particle which contains a base particle and an organosilicon polymer on the surface of the base particle, and wherein the organosilicon polymer has a structure represented by formula (1) below, and wherein the organosilicon polymer forms protrusions on the toner base particle surface, and wherein, in a flat image obtained by observing a cross-section of the composite particle with a scanning transmission electron microscope STEM, drawing a line along the circumference of the base particle surface and converting based on this line along the circumference, and assuming that the length of the line along the circumference for a segment where a protrusion and the toner base particle from a continuous interface is taken as a protrusion width w, the maximum length of a protrusion in the direction normal to the protrusion width w is taken as a protrusion diameter d, and the length, in the line segment that forms the protrusion diameter d, from the peak of the protrusion to the line along the circumference is taken as a protrusion height h, the numerical proportion P (d/w), in protrusions having a protrusion height h from 40 nm to 300 nm, of protrusions having a ratio d/w of protrusion diameter d to protrusion width w from 0.33 to 0.80 is at least 70 number %, and wherein the protrusion is transported from the surface of the base particle to the contact area by the rotation of the image bearing member rotates;

$$R—SiO_{3/2} \quad (1)$$

in the formula, R is a $C_{1-6}$ alkyl group or phenyl group.

To achieve this object, the image forming apparatus of the present invention comprises the following:

a frame, an image bearing member that is rotatably supported by the frame and carries a developer image consisting of a developer, a developer carrying member that supplies developer to the image bearing member so that a latent image formed on the image bearing member is developed into the developer image, and a cleaning member provided on the frame that cleans developer remaining on the surface of the image bearing member after the developer image has been transferred from the image bearing member, and that has a contact portion capable of coming into contact with the surface of the image bearing member, wherein during use, an intervening particle is present in an adjacent region, which is located on an upstream side of a contact area between the contact portion and the image bearing member, and which is adjacent to the contact area, in the rotation direction of the image bearing member, wherein the intervening particle is a composite particle having a first particle which contains a base particle and an organosilicon polymer on the surface of the base particle, and wherein the organosilicon polymer has a structure represented by formula (1) below, and wherein the organosilicon polymer forms protrusions on the toner base particle surface, and wherein, in a flat image obtained by observing a cross-section of the composite particle with a scanning transmission electron microscope STEM, drawing a line along the circumference of the base particle surface, and converting based on this line along the circumference, and assuming that the length of the line along the circumference for a segment where a protrusion and the toner base particle from a continuous interface is taken as a protrusion width w, the maximum length of a protrusion in the direction normal to the protrusion width w is taken as a protrusion diameter d, and the length, in the line segment that forms the protrusion diameter, from the peak of the protrusion to the line along the circumference is taken as a protrusion height h, the numerical proportion P(d/W), in protrusions having a protrusion height h from 40 nm to 300 nm, of protrusions having a ratio d/w of protrusion diameter d to protrusion width w from 0.33 to 0.80 is at least 70 number %, and wherein the protrusion is transported from the surface of the base particle to the contact area by the rotation of the image bearing member;

$$R—SiO_{3/2} \quad (1)$$

in the formula, R is a $C_{1-6}$ alkyl group or phenyl group.

The present invention can provide a process cartridge and an image forming apparatus whereby an increase in the drive torque for driving an image bearing member can be controlled.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Example 1

Image Forming Apparatus

Figure 1:
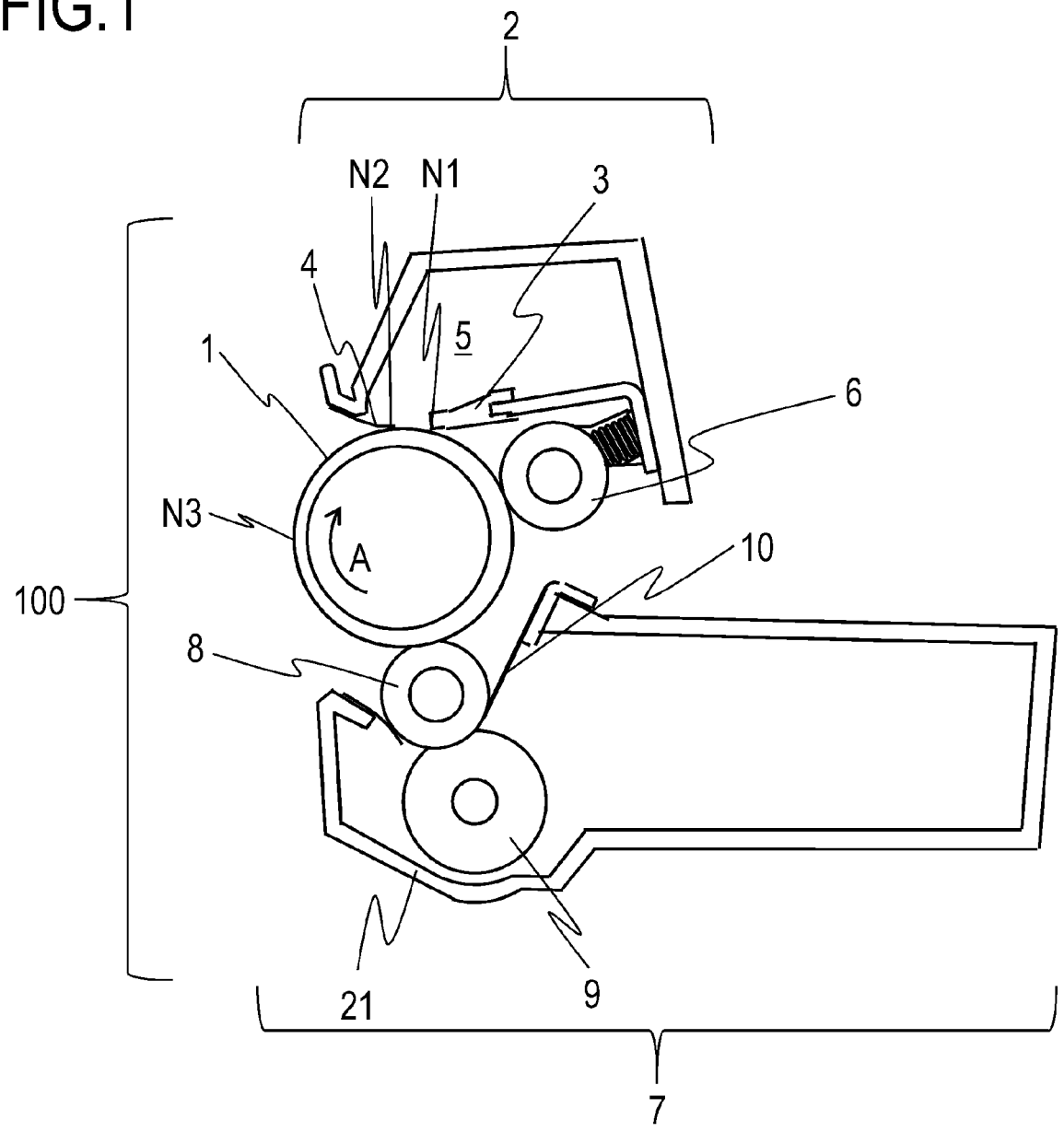
FIG. 1 is a schematic sectional view of a process cartridge of Example 1.
Figure 2:
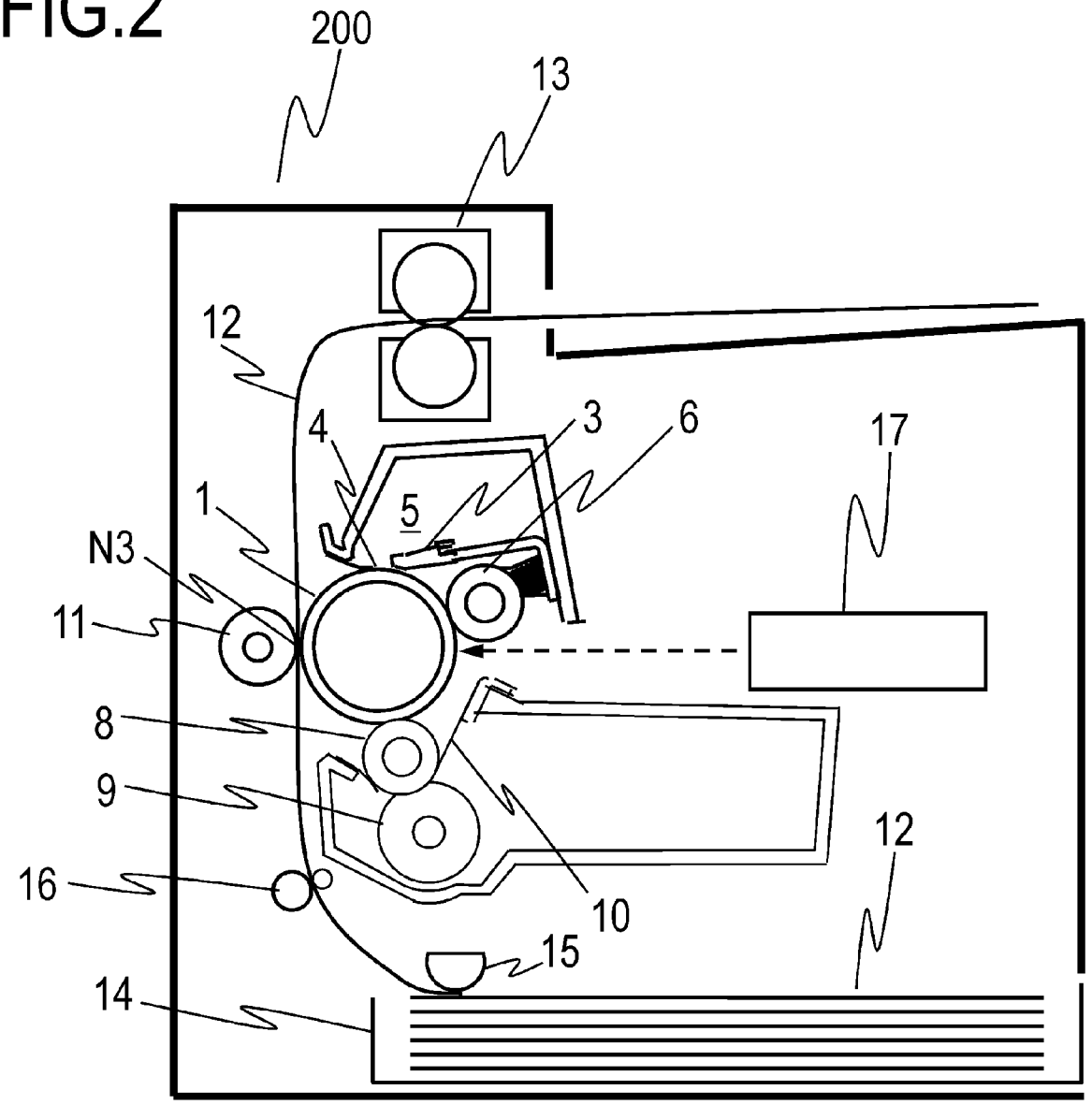
FIG. 2 is a schematic sectional view of an image forming apparatus of Example 1.

FIG. 1 is a schematic sectional view explaining the configuration of a process cartridge 100 of Example 1 of a first embodiment of the present invention, and FIG. 2 is a schematic sectional view explaining the configuration of an image forming apparatus 200 of Example 1 of the present invention using this process cartridge 100. Each of the sectional views used in the following explanations including FIGS. 1 and 2 show cross-sections as viewed in the rotational axis direction of the photosensitive drum 1 used as the image bearing member (that is, cut perpendicular to this rotational axis). In this example, the image forming apparatus 200 is configured by mounting the process cartridge 100 on an image forming apparatus main body. That is, the constituent parts of the image forming apparatus 200 other than the process cartridge 100 constitute the main body of the apparatus. The process cartridge 100 comprises a photosensitive drum 1, a charging roller 6, a developing apparatus 7 and a cleaning apparatus 2, and these are integrated together as a whole.

The image forming apparatus 200 is configured as follows. The photosensitive drum 1 is provided in the center as an electrophotographic photosensitive member for forming electrostatic latent images on the surface thereof. Various process means are then disposed around this photosensitive drum 1. That is, the charging roller 6 is provided as a charging means for charging the surface of the photosensitive drum 1 uniformly to a negative polarity, and a light exposure apparatus 17 is provided for forming an electrostatic latent image by laser exposure on the charged photosensitive drum 1 in response to printing data and image data. The developing apparatus 7 is provided as a developing means for making the formed electrostatic latent image visible by reverse developing negatively charged toner on the electrostatic latent image. A transfer roller 11 is also provided as a transfer means for transferring the visible toner image (developer image) to recording material 12 as a recording medium (transfer material). Furthermore, a fixing apparatus 13 is provided for permanently fixing the transferred toner image on the recording material 12. A paper cassette 14, a feed roller 15 and a registration roller 16 are also provided as feed equipment for supplying the recording material 12. The cleaning apparatus 2 is also provided for removing untransferred toner that has remained on the photosensitive drum 1 rather than being transferred to the recording material 12 in the transfer step.

The charging roller 6 of this example is disposed in contact with the photosensitive drum 1 so that it rotates in conjunction with the rotation of the photosensitive drum 1. In this example, DC voltage of about −1,000 V is applied by a charging bias power supply (not shown) to the charging roller 6 during image formation, and the surface potential on the photosensitive drum 1 is charged to a dark potential (VD) of −500 V.

Once the surface of the photosensitive drum 1 has been charged to a dark potential by the charging roller 6, it is exposed by the exposure apparatus 17 in response to printing information, image information and the like, forming an electrostatic latent image. The potential of the exposed part becomes a light potential (VL) of −100 V.

The developing apparatus 7 comprises a developing roller 8, a supply roller 9 and a developing blade 10. The developing roller 8 of this example, which is a developer carrying member having a two-layer configuration comprising an acrylic-urethane rubber coated on the surface of a base layer of silicon rubber on a metal core, develops electrostatic latent images on the photosensitive drum 1. The supply roller 9, which supplies toner to the developing roller 8, comprises a urethane sponge on a metal core. The metal developing blade 10 regulates the toner layer thickness on the developing roller 8 and charges the toner to a negative polarity. The developing roller 8 is arranged so as to perform development in contact with the photosensitive drum 1. During image formation, about −300 V of DC voltage is applied to the developing roller 8 by a developing bias power supply (not shown) to reverse develop the electrostatic latent image formed on the photosensitive drum 1 and make the electrostatic latent image visible as a toner image.

The transfer roller 11 consisting of an EPDM sponge and a transfer bias power source (not shown) for applying voltage to this transfer roller 11 are provided as transfer means in this embodiment. The voltage applied to the transfer roller 11 is subject to constant voltage control during image formation. The toner image on the photosensitive drum 1 is transferred to the recording material 12 in the transfer nip N3, which is the transfer position where the transfer roller 11 faces the photosensitive drum 1.

The recording material 12 contained in the paper cassette 14 is supplied by the feed roller 15 to the registration roller 16 in synchronization with the formation of the visible image on the photosensitive drum 1. This recording material 12 is then conveyed between the transfer roller 11 and the photosensitive drum 1 by the registration roller 16 in synchronization with the leading end of the visible image formed on the photosensitive drum 1. About +1,500 V of DC voltage is applied to the transfer roller 11 to transfer the toner image to the recording material 12.

The toner image transferred to the recording material 12 is transported together with the recording material 12 to the fixing apparatus 13, where it is fixed by application of heat and pressure to obtain a recorded image.

Meanwhile, untransferred toner that has remained on the photosensitive drum 1 without being transferred to the recording material 12 after passing through the nip N3 between the transfer roller 11 and the drum is moved to the cleaning apparatus 2.

The cleaning apparatus 2 includes a cleaning blade 3 as a cleaning member, a seal sheet 4 as a seal member, and a frame that supports these members while forming a waste toner storage container 5 between them and the photosensitive drum 1. The frame of the cleaning apparatus 2 both supports the photosensitive drum 1 rotatably and supports the charging roller 6 rotatably so as to maintain a predetermined contact state between the charging roller 6 and the photosensitive drum 1. After first passing through the seal sheet 4, which is a seal member in light contact with the photosensitive drum 1, the toner is removed from the photosensitive drum 1 by the cleaning blade 3, which is a cleaning member consisting of polyurethane rubber. The removed toner is then contained in the waste toner storage container 5. After this, the surface of the photosensitive drum 1 is charged again by the charging roller 6 in preparation for the next image formation.

Cleaning Apparatus

Figure 3:
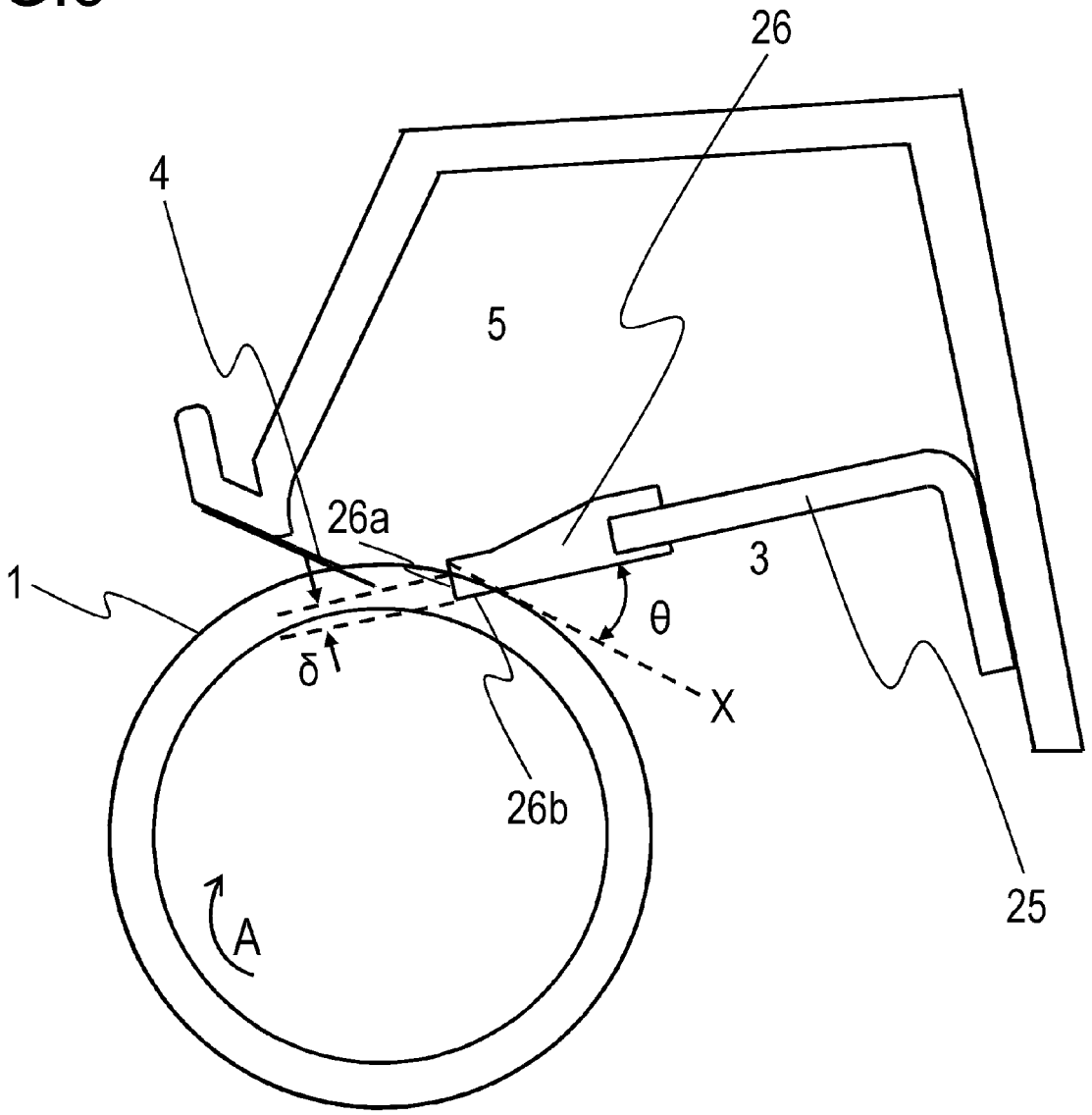
FIG. 3 is a schematic sectional view of a cleaning apparatus of Example 1.

The cleaning apparatus 2 of this example is explained using FIG. 3.

The cleaning blade 3 is fixed to the frame of the cleaning apparatus 2. The cleaning blade 3 comprises a support member 25 as a metal substrate support and a cleaning part 26 as an elastic body consisting of a thermosetting resin. Residual toner (residual developer) on the photosensitive drum 1 is removed by bringing the tip ridge part of the cleaning part 26 into contact with the photosensitive drum 1.

One end of the cleaning part 26 is fixed to the plate-shaped support member (metal plate) 25, and the other, free end constitutes a contact portion capable of coming into contact with the photosensitive drum 1, thereby forming a cleaning nip N1, which is the contact region with the photosensitive drum 1.

The support member 25 is fixed to the frame of the cleaning apparatus 2. One end of the support member 25 is fixed to the frame of the cleaning apparatus 2, and the cleaning part 26 is fixed to the other, free end. The support member 25 is bent in an L shape, and one plate part of the L shape is fixed to the frame of the cleaning apparatus 2 by a fastener such as a screw, while the cleaning part 26 is fixed to the tip of the other plate part, which extends in a direction roughly perpendicular to the first plate part. The support member 25 (other plate part) and the cleaning part 26 extend as an integral body in roughly the same direction from the fixed end (first plate part) of the support member 25. The direction in which they extend is the opposite direction (reverse direction) to the rotation direction of the photosensitive drum 1 at the part where the end (other end) of the cleaning part 26 comes into contact with the peripheral surface of the photosensitive drum 1, or in other words the counter direction.

The positioning of the process cartridge 100 in the drawings is the positioning when the cartridge is mounted on the main body of the image forming apparatus (during use), and descriptions of the positional relationships, directions and the like of the various members of the process cartridge 100 in this Description pertain to the positional relationships, directions and the like in this positioning. That is, the up-down direction of the paper surface corresponds to the perpendicular direction in the drawings, and the left-right direction of the paper surface corresponds to the horizontal direction. The positional configuration is set on the assumption that the image forming apparatus 200 is in a normal installation condition on a horizontal surface.

In the cleaning part 26, an angle of 90° is formed by the cut surface 26*a* (the tip surface of the cleaning part 26) and the air surface 26*b* (the lower surface of the cleaning part 26), which are adjacent to each other on either side of the tip ridge across the full width of the cleaning blade 3 in the longitudinal direction. The cut surface 26*a* has a thickness of 1.8 mm.

The intrusion amount δ of the cleaning part 26 is the virtual amount of intrusion into the photosensitive drum 1 without deformation of the blade tip ridge part. The set angle θ of the cleaning part 26 is the angle formed by the air surface 26*b* with the tangent X at the intersection between the air surface 26*b* and the photosensitive drum 1. Such a cleaning part 26 is set up so as to come into contact with the photosensitive drum 1 with a specific intrusion amount δ and set angle θ. Cleaning is thus performed in a state where the cleaning member 2 and the photosensitive drum 1 are in contact with each other at a desired contact pressure. In this example, the blade intrusion amount δ is set at 0.7 mm, and the blade set angle θ at 22°.

When the cleaning part 26 is brought into contact with the photosensitive drum 1, the air surface 26*b* of the cleaning part 26 is pulled by the frictional force between it and the photosensitive drum 1, forming a curl-down part where the tip is curled. Toner intrusion is prevented because load is concentrated in the curl-down part of the tip where the cleaning part 26 is in contact the photosensitive drum 1.

Seal Sheet

The seal sheet 4 that is a feature of this example is explained next.

One end of the seal sheet 4 is fixed to the frame of the cleaning apparatus 2, while the other, free end is provided in contact with the peripheral surface of the photosensitive drum 1. The extension direction extending from the one end of the seal sheet 4 toward the other end is roughly the same direction as the rotation direction of the photosensitive drum 1 at the part where the tip (other end) of the seal sheet 4 comes into contact with the peripheral surface of the photosensitive drum 1, or in other words the forward direction. The seal sheet 4 allows toner to move from upstream on the peripheral surface of the photosensitive drum 1 from the contact part N2 in the rotation direction of the photosensitive drum 1 to downstream from the contact part N2 while coming into contact with the photosensitive drum 1 so as to regulate movement from the downstream side to the upstream side upstream from the contact part N2.

A sheet-shaped member having either (i) a greater work function than the toner or (ii) a work function not much different from that of the toner is used as the material of the seal sheet 4 of this example.

In more detail, (i) the value of the work function of the material of the seal sheet 4 is greater than the work function of the toner at the same polarity as the normal charging polarity of the toner. Moreover, (ii) even if the value of work function of the material of the seal sheet 4 is different from the work function of the toner at the reverse polarity from the normal charging polarity of the toner, the absolute value of the difference is within a predetermined range. In other words, it is a feature of this example that the seal sheet 4 is composed of a material having a work function such that the charged state of the toner is not increased by rubbing with the seal sheet 4.

Specifically, a sheet comprising a PTFE tape (3M Company, PTFE tape, product number 5490) affixed to the surface of a PET sheet (Toray Industries, Inc., Lumirror®) was used as a (i) material having a large difference in work function from the toner. In this case, the surface having the affixed PTFE tape was brought into contact with the photosensitive drum 1.

A PET sheet (Toray Industries, Inc., Lumirror®) was used as a (ii) material having a small difference in work function from the toner.

The work function (Φ) of the seal sheet 4 was measured using a photoelectron spectroscope (Riken Keiki Co., Ltd., AC-2). In this example, a deuterium lamp was used in this apparatus and measurement was performed with the irradiation light quantity and energy scanning range set appropriately. The work function was then calculated by arithmetic processing using the work function analysis software built into the device.

The results showed that the work function of the PTFE tape was 5.75 eV, and the work function of the PET sheet was 5.42 eV.

The seal sheet 4 is also installed relative to the photosensitive drum 1 in such a way that toner that has accumulated in the waste toner storage container 5 does not leak from the contact part N2 between the photosensitive drum 1 and the seal sheet 4. Furthermore, the contact pressure between the photosensitive drum 1 and the seal sheet 4 is set to a value that allows the toner on the photosensitive drum 1 to be passed through the contact part N2 between the photosensitive drum 1 and the seal sheet 4 by the movement of the photosensitive drum 1 without damaging the surface layer of the photosensitive drum 1.

Toner

The toner used in this example is explained next.

The toner of the present invention has protrusions containing an organosilicon polymer on the toner particle surface. These protrusions are in surface contact with the surface of the toner base particle. Due to this surface contact, a dramatic suppression effect on transfer, detachment and burial of the protrusions can be expected. Cross-sectional observation of the toner by STEM was performed to assess the degree of surface contact. FIGS. 4 to 7 show schematic views of such toner particle protrusions.

Figure 4:
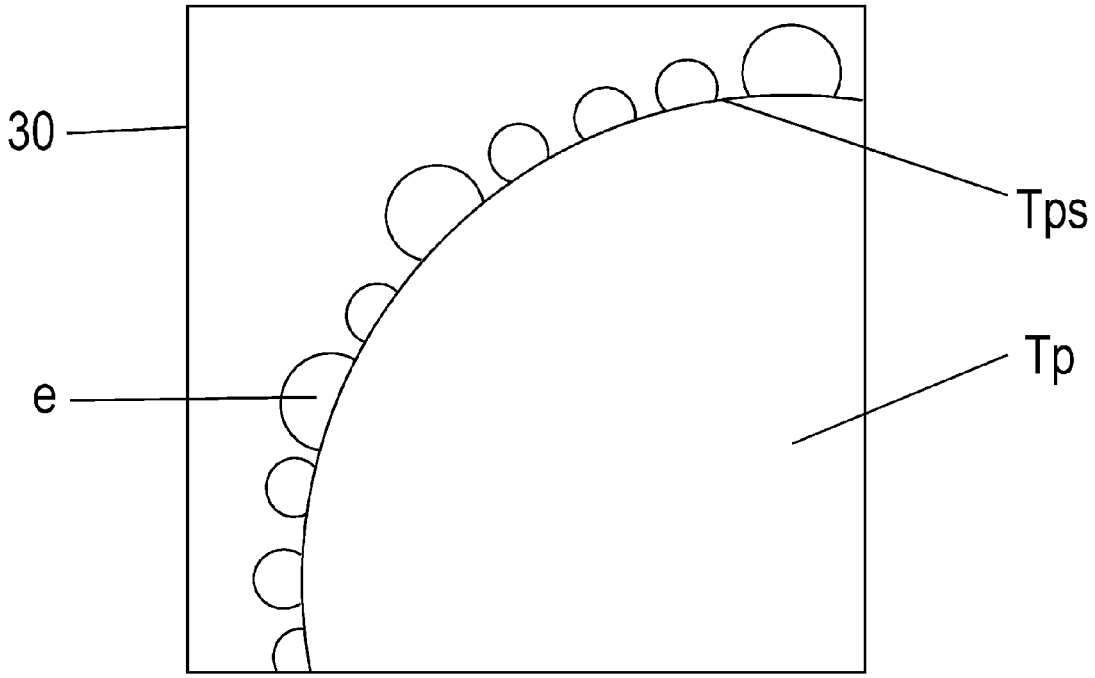
FIG. 4 is a schematic diagram of a protrusion of a toner particle in Example 1.

30 in FIG. 4 is a STEM image illustrating about ¼ of the cross-sectional configuration of a toner particle, in which Tp is the toner base particle, Tps is the toner base particle surface, and e is a protrusion. That is, this image shows the cross-sectional configuration of one of four quadrants of a coordinate system whose origin is the center of the toner particle cross-section, and it is supposed that the other three quadrants have symmetrically similar configurations.

A cross-sectional image of the toner is observed, and a line is drawn tracing the circumference of the toner base particle surface. This is then converted to a flat image based on the line tracing the circumference. In this flat image, the length of a line tracing the circumference at the part where a continuous interface is formed between the protrusion and the toner base particle is given as the protrusion width w. The maximum length of the protrusion in the normal direction of the protrusion width w is given as the protrusion diameter d, and the length from the peak of the protrusion in the line segment forming the protrusion diameter d to the line tracing the circumference is given as the protrusion height h.

Figure 5:
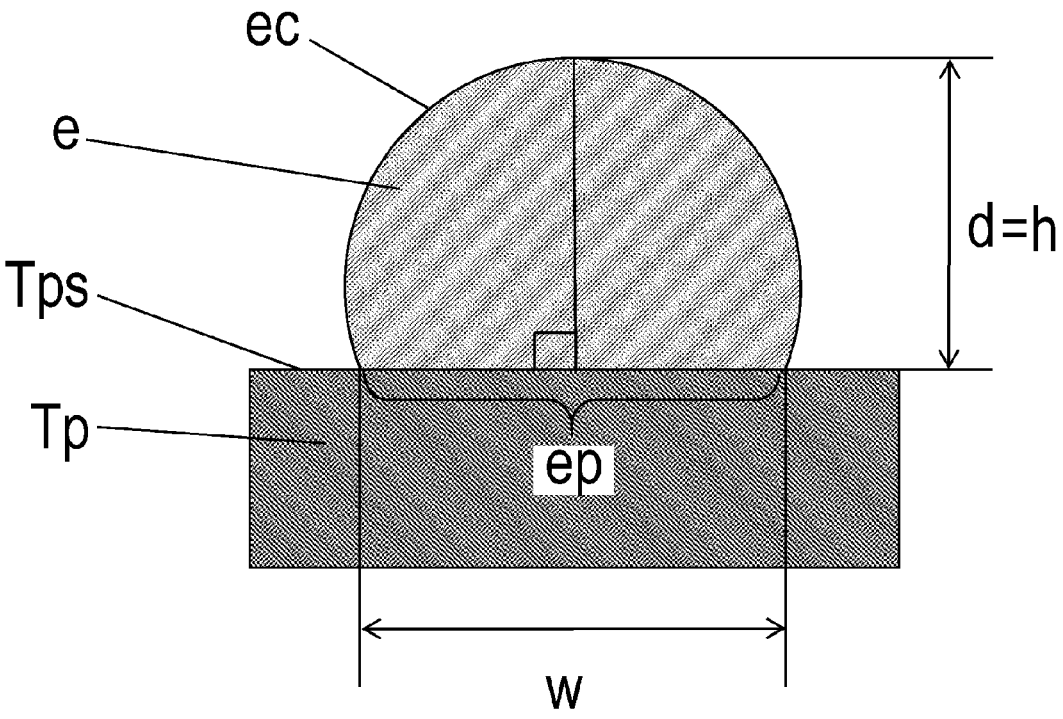
FIG. 5 is a schematic diagram of a protrusion of a toner particle in Example 1.
Figure 6:
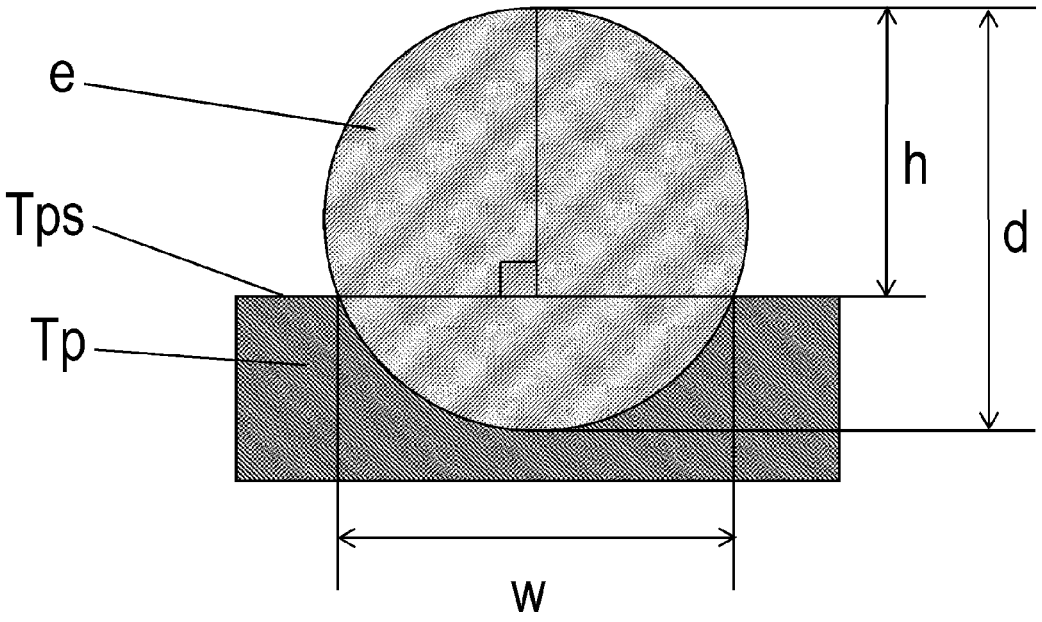
FIG. 6 is a schematic diagram of a protrusion of a toner particle in Example 1.
Figure 7:
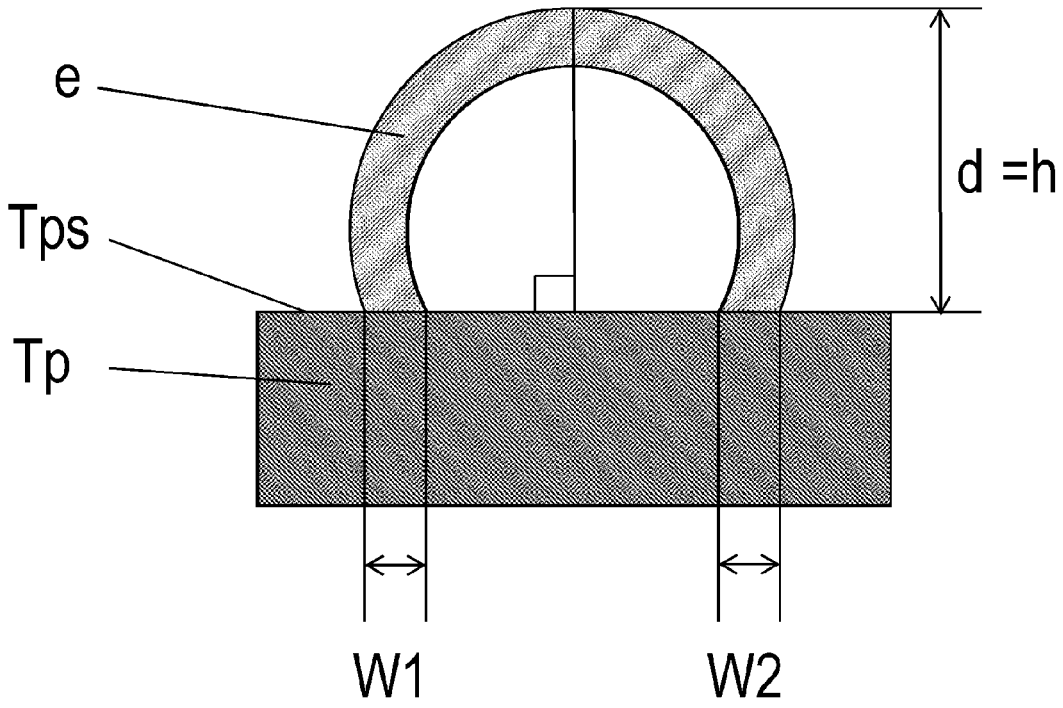
FIG. 7 is a schematic diagram of a protrusion of a toner particle in Example 1.

The results of cross-sectional observation showed three typical configurations of the protrusion e as shown in FIGS. 5 to 7. Most of the protrusions formed in a toner manufactured by the manufacturing method of this example as described below had the configuration of the protrusion e shown in FIG. 5, which is a protrusion e having a flat part ep and a curved part ec as described below.

In FIGS. 5 to 7, the protrusion height h is the same as the protrusion diameter d, while in FIG. 6 the protrusion diameter d is greater than the protrusion height h.

FIG. 7 illustrates the adhering state of a particle characterized as a bowl-shaped particle, which is a hemispherical particle with a bowl-shaped center obtained by crushing, cracking or the like of a hollow particle. In FIG. 7, the protrusion width w is the total length of the organosilicon compound that is in contact with the surface of the toner base particle. That is, in FIG. 7 the protrusion width w is the total of W1 and W2.

Based on these conditions, we discovered that with protrusions of an organosilicon compound, transfer, detachment and burial of the protrusions are unlikely with a convex shape in which the ratio d/w of the protrusion diameter d to the protrusion width w is at least 0.33 and not more than 0.80. That is, in the case of protrusions with a protrusion height h of at least 40 nm and not more than 300 nm, we discovered that excellent transferability capable of withstanding long-term use could be obtained if the quantity ratio P(d/w) of protrusions with a ratio d/w of at least 0.33 and not more than 0.80 was at least 70 number %.

It is thought that transferability is improved with protrusions of at least 40 nm because these exert a spacer effect between the toner base particle surface and the transfer member. Moreover, it appears that with protrusions of not more than 300 nm, a suppression effect on transfer, detachment and burial is exhibited significantly throughout an endurance evaluation.

We found that if the quantity ratio P(d/w) is at least 70 number % as a percentage of protrusions of at least 40 nm and not more than 300 nm, an even greater member contamination suppression effect can be obtained while maintaining transferability throughout long-term use. The P(d/w) is preferably at least 75 number % or more preferably at least 80 number %. There is no particular upper limit, but preferably it is not more than 99 number %, or more preferably not more than 98 number %.

In cross-sectional observation of the toner with a scanning transmission electron microscope (STEM), moreover, given perimeter length L as the width of the flat image (length of a line tracing the circumference of the toner base particle surface) and Ew as the total of the protrusion widths w of protrusions with a protrusion height h of at least 40 nm and not more than 300 nm out of the organosilicon polymer protrusions present in the same flat image, Σw/L is preferably at least 0.30 and not more than 0.90.

If Σw/L is at least 0.30, transferability and suppression of member contamination are improved, while if Σw/L is not more than 0.90, transferability is more excellent. Ew/L is more preferably at least 0.45 and not more than 0.80.

The fixing rate of the organosilicon polymer in the toner is preferably at least 80 mass %. If the fixing rate is at least 80 mass %, transferability and suppression of member contamination can be more easily sustained throughout long-term use. This fixing rate is more preferably at least 90 mass %, or still more preferably at least 95 mass %. There is no particular upper limit, but preferably it is not more than 99 mass %, or more preferably not more than 98 mass %. Examples of methods for controlling this fixing rate include methods of controlling the addition rate of the organosilicon polymer, the reaction temperature, the reaction time, the pH during the reaction and the timing of pH adjustment when adding and polymerizing the organosilicon compound.

To further improve transferability, taking the cumulative distribution of the protrusion heights h of protrusions with a protrusion height h of 40 nm to 300 nm, and given h 80 as the protrusion height h at 80 number % integrated from the smaller protrusion height h, this h 80 is preferably at least 65 nm, or more preferably at least 75 nm. There is no particular upper limit, but more preferably it is not more than 120 nm, or still more preferably not more than 100 nm.

In observation of the toner with a scanning electron microscope (SEM), given protrusion diameter R as the maximum diameter of protrusions of the organosilicon polymer, the number-average of this protrusion diameter R is preferably at least 20 nm and not more than 80 nm, or more preferably at least 35 nm and not more than 60 nm. Within this range, member contamination is less likely to occur.

The toner contains an organosilicon polymer having a structure represented by formula (1) below:

[C3]

$$R—SiO_{3/2} \quad (1)$$

(in which R represents a $C_{1-6}$ alkyl group or phenyl group).

In an organosilicon polymer having the structure of formula (1), one of the four valence electrons of the Si atom bonds with R, and the other three bond with O atoms. Both of the valence electrons of the O atom bond with Si atoms, constituting a siloxane bond (Si—O—Si). Looking at the Si atoms and O atoms of the organosilicon polymer, the structure is represented as —$SiO_{3/2}$ because there are two Si atoms and three O atoms. The —$SiO_{3/2}$— structure of this organosilicon polymer is thought to have properties similar to silica ($SiO_2$) composed of many siloxane bonds.

In the partial structure represented by formula (1), R is preferably a $C_{1-6}$ alkyl group, and more preferably a $C_{1-3}$ alkyl group.

A methyl, ethyl or propyl group is preferred as the $C_{1-3}$ alkyl group, and more preferably R is a methyl group.

The organosilicon polymer is preferably a condensation polymer of an organosilicon compound having a structure represented by formula (Z) below:

[C4]

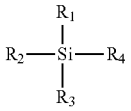

(Z)

(in (Z), $R_1$ represents a $C_{1-6}$ hydrocarbon (preferably alkyl) group, and each of $R_2$, $R_3$ and $R_4$ independently represents a halogen atom, hydroxy group, acetoxy group or alkoxy group).

$R_1$ is preferably a $C_{1-3}$ aliphatic hydrocarbon group, or more preferably a methyl group.

Each of $R_2$, $R_3$ and $R_4$ independently represents a halogen atom, hydroxy group, acetoxy group or alkoxy group (hereunder also called a reactive group). These reactive groups form crosslinked structures by hydrolysis, addition polymerization and condensation polymerization.

From the standpoint of gradual hydrolysis at room temperature and deposition on the surface of the toner base particle, a $C_{1-3}$ alkoxy group is preferred, and a methoxy or ethoxy group is more preferred.

Hydrolysis, addition polymerization and condensation polymerization of $R_2$, $R_3$ and $R_4$ can be controlled by controlling the reaction temperature, reaction time, reaction solvent and pH. One kind of organosilicon compound having three functional groups ($R_2$, $R_3$ and $R_4$) in the molecule apart from $R_1$ in formula (Z) above (also called a trifunctional silane below) or a combination of multiple kinds may be used to obtain the organosilicon polymer used in the present invention.

Examples of compounds represented by the formula (Z) above include the following: trifunctional methyl silanes such as methyl trimethoxysilane, methyl triethoxysilane, methyl diethoxymethoxysilane, methyl ethoxydimethoxysilane, methyl trichlorosilane, methyl methoxydichlorosilane, methyl ethoxydichlorosilane, methyl dimethoxychlorosilane, methyl methoxyethoxychlorosilane, methyl diethoxychlorosilane, methyl triacetoxysilane, methyl di acetoxymethoxysilane, methyl diacetoxyethoxysilane, methyl acetoxydimethoxysilane, methyl acetoxymethoxyethoxysilane, methyl acetoxydiethoxysilane, methyltrihydroxysilane, methyl methoxydihydroxysilane, methyl ethoxydihydroxysilane, methyldimethoxyhydroxysilane, methyl ethoxymethoxyhydroxysilane and methyl diethoxyhydroxysilane;

trifunctional silanes such as ethyl trimethoxysilane, ethyl triethoxysilane, ethyl trichlorosilane, ethyl triacetoxysilane, ethyl trihydroxysilane, propyl trimethoxysilane, propyl triethoxysilane, propyl trichlorosilane, propyl triacetoxysilane, propyl trihydroxysilane, butyl trimethoxysilane, butyl triethoxysilane, butyl trichlorosilane, butyl triacetoxysilane, butyl trihydroxysilane, hexyl trimethoxysilane, hexyl triethoxysilane, hexyl trichlorosilane, hexyl triacetoxysilane and hexyl trihydroxysilane; and trifunctional phenyl silanes such as phenyl trimethoxysilane, phenyl triethoxysilane, phenyl trichlorosilane, phenyl triacetoxysilane and phenyl trihydroxysilane.

An organosilicon polymer obtained by combining the following with an organisilicon compound having a structure represented by formula (Z) may also be used as long as this does not detract from the effects of the invention: an organosilicon compound having four reactive groups in the molecule (tetrafunctional silane), an organosilicon compound having two reactive groups in the molecule (bifunctional silane), or an organosilicon compound having one reactive group (monofunctional silane). Examples of these include dimethyl diethoxysilane, tetraethoxysilane, hexamethyl di silazane, 3-aminopropyl trimethoxysilane, 3-aminopropyl triethoxysilane, 3-(2-aminoethyl)aminopropyl trimethoxysilane, 3-(2-aminoethyl)aminopropyl triethoxysilane, and trifunctional vinyl silanes such as vinyl triisocyanatosilane, vinyl trimethoxysilane, vinyl triethoxysilane, vinyl diethoxymethoxysilane, vinyl ethoxydimethoxysilane, vinyl ethoxydihydroxysilane, vinyl dimethoxyhydroxysilane, vinyl ehtoxymethoxyhydroysilane and vinyl diethoxyhydroxilane.

The content of the organosilicon polymer in the toner particle is preferably at least 1.0 mass % and not more than 10.0 mass %.

One preferred method for forming these specific convex shapes on the toner particle surface is to first disperse the toner base particle in an aqueous medium to obtain a toner base particle dispersion, and then add an organosilicon compound to form convex shapes and obtain a toner particle dispersion.

The solids concentration of the toner base particle dispersion is preferably adjusted to a at least 25 mass % and not more than 50 mass %. Moreover, the temperature of the toner base particle dispersion is preferably first adjusted to at least 35° C. Furthermore, the pH of this toner base particle dispersion is preferably adjusted to a pH at which condensation of the organosilicon compound does not progress easily. Because the pH at which condensation of the organosilicon polymer does not progress easily differs depending on the substance, the pH is preferably within ±0.5 of the pH at which the reaction is most unlikely to progress.

It is also desirable to use an organosilicon compound that has been subjected to hydrolysis treatment. For example, hydrolysis is first performed in a separate container to pre-treat the organosilicon compound. The hydrolysis charge concentration is preferably at least 40 mass parts and not more than 500 mass parts, or more preferably at least 100 mass parts and not more than 400 mass parts of water from which the ion component has been removed, such as ion exchange water or RO water, per 100 mass parts of the organosilicon compound. For the hydrolysis conditions, preferably the pH is 2 to 7, the temperature is 15° C. to 80° C., and the time is 30 to 600 minutes.

The resulting hydrolysis solution is mixed with the toner base particle dispersion and adjusted to a suitable pH for condensation (preferably 6 to 12, or 1 to 3, or more preferably 8 to 12). To facilitate formation of convex shapes, the amount of the hydrolysis solution is adjusted to at least 5.0 mass parts and not more than 30.0 mass parts of the organosilicon compound per 100 mass parts of the toner base particle. As the temperature and time for condensation and protrusion shape formation, the temperature is preferably maintained at 35° C. to 99° C. for 60 minutes to 72 hours.

Moreover, the pH is preferably adjusted in two stages to control the convex shapes on the surface of the toner particles. The shapes of the protrusions on the toner particle surface can be controlled by appropriately adjusting the holding time before pH adjustment and the holding time before the second-stage pH adjustment when condensing the organosilicon compound. For example, the pH is preferably maintained at pH 4.0 to 6.0 for 0.5 hours to 1.5 hours, and then maintained at pH 8.0 to 11.0 for 3.0 hours to 5.0 hours. The shapes of the protrusions can also be controlled by adjusting the condensation temperature of the organic compound within the range of 35° C. to 80° C.

The protrusion width w can be controlled for example by controlling the added amount of the organosilicon compound, the reaction temperature, and the pH and reaction time in the first stage. For example, the protrusion width tends to be greater the longer the reaction time in the first stage.

Furthermore, the protrusion diameter d and protrusion height h can be controlled by controlling the added amount of the organosilicon compound, the reaction temperature, and the pH and the like in the second stage. For example, the protrusion diameter d and protrusion height h tend to be greater the higher the reaction pH in the second stage.

Specific toner manufacturing examples are explained below, but the invention is not limited to these examples.

Preferably the toner base particle is manufactured in an aqueous medium, and protrusions contained an organosilicon compound are formed on the surface of the toner base particle.

A suspension polymerization method, dissolution suspension method or emulsification aggregation method is preferred as the method for manufacturing the toner base particle, and a suspension polymerization method is especially preferred. In a suspension polymerization method, the organosilicon polymer can be easily precipitated onto the surface of the toner base particle and the adhesiveness of the organosilicon compound is excellent, resulting in good environmental stability, suppression of charge amount reversal components, and durable continuity of these features. A suspension polymerization method is explained in more detail below.

In suspension polymerization, a polymerizable monomer composition containing a polymerizable monomer capable of generating a binder resin together with additives such as colorants as necessary is granulated in an aqueous medium, and the polymerizable monomer contained in the polymerizable monomer composition is polymerized to obtain a toner base particle.

A release agent or another resin may be added as necessary to the polymerizable monomer composition. After completion of the polymerization step, the resulting particle may be collected by washing and filtration using known methods. The temperature may also be raised during the second half of this polymerization step. Part of the dispersion medium may also be distilled off during the second half of the polymerization step or after completion of the polymerization step in order to remove unreacted polymerizable monomers or by-products.

Protrusions of an organic silicon polymer are preferably formed by the methods described above using a toner base particle thus obtained.

A release agent may also be used in the toner. Examples of the release agent include the following: petroleum waxes such as paraffin wax, microcrystalline wax and petrolatum, and their derivatives, montan wax and its derivatives, hydrocarbon waxes obtained by the Fischer-Tropsch method, and their derivatives, polyolefin waxes such as polyethylene and polypropylene wax, and their derivatives, natural waxes such as carnauba wax and candelilla wax, and their derivatives, higher fatty alcohols, fatty acids such as stearic acid and palmitic acid, or their acid amides, esters or ketones, hydrogenated castor oil and its derivatives, plant waxes, animal waxes, and silicone resin.

Derivatives include oxides, block copolymers with vinyl monomers, and modified grafts. One release agent alone or a mixture of multiple kinds may be used.

The content of the release agent is preferably at least 2.0 and not more than 30.0 mass parts per 100 mass parts of the binder resin or the polymerizable monomer for producing the binder resin.

The following resins for example may be used as the other resin: monopolymers of styrenes and substituted styrenes, such as polystyrene and polyvinyl toluene; styrene copolymers such as styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer and styrene-maleic acid ester copolymer; and polymethyl methacrylate, polybutyl methacrylate, polyvinyl acetate, polyethylene, polypropylene, polyvinyl butyral, silicone resin, polyester resin, polyamide resin, epoxy resin, polyacrylic resin, rosin, modified rosin, terpene resin, phenolic resin, aliphatic or alicyclic hydrocarbon resin, and aromatic petroleum resin. These may be used individually, or a mixture of multiple kinds may be used.

Desirable examples of the polymerizable monomer include the following vinyl polymerizable monomers: styrene; styrene derivatives such as α-methylstyrene, β-methylstyrene, o-methylstyrene, m-methylstyrene, p-methyl styrene, 2,4-dimethylstyrene, p-n-butylstyrene, p-tert-butyl styrene, p-n-hexylstyrene, p-n-octyl styrene, p-n-nonylstyrene, p-n-decylstyrene, p-n-dodecyl styrene, p-methoxystyrene and p-phenylstyrene; acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxyethyl acrylate; methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylic acid esters; vinyl esters such as vinyl acetate, vinyl propionate, vinyl benzoate, vinyl butyrate and vinyl formate; vinyl ethers such as vinyl methyl ether, vinyl ethyl ether and vinyl isobutyl ether; and vinyl methyl ketone, vinyl hexyl ketone and vinyl isopropyl ketone.

Of these vinyl polymers, styrene, styrene derivatives, acrylic polymerizable monomers and methacrylic polymerizable monomers are preferred.

A polymerization initiator may also be added when polymerizing the polymerizable monomer. Examples of the polymerization initiator include the following: azo or diazo polymerization initiators such as 2,2'-azobis-(2,4-divaleronitrile), 2,2'-azobisisobutyronitrile, 1,1'-azobis(cyclohexane-1-carbonitrile), 2,2'-azobis-4-methoxy-2,4-dimethylvaleronitrile and azobisisobutyronitrile; and peroxide polymerization initiators such as benzoyl peroxide, methyl ethyl ketone peroxide, diisopropyl oxycarbonate, cumene hydroperoxide, 2,4-dichlorobenzoyl peroxide and lauroyl peroxide.

These polymerization initiators are preferably added in the amount of 0.5 to 30.0 mass parts per 100 mass parts of the polymerizable monomer, and one or multiple kinds may be used.

A chain transfer agent may also be added when polymerizing the polymerizable monomer to control the molecular weight of the binder resin constituting the toner base particle. The added amount is preferably 0.001 to 15.000 mass parts per 100 mass parts of the polymerizable monomer.

A crosslinking agent may also be added when polymerizing the polymerizable monomer to control the molecular weight of the binder resin constituting the toner base particle.

Examples include the following: divinyl benzene, bis(4-acryloxypolyethoxyphenyl) propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycol #200, #400 and #600, dipropylene glycol diacrylate, polypropylene glycol diacrylate, polyester diacrylate (MANDA, Nippon Kayaku Co., Ltd.) and these acrylates converted to methacrylates.

Examples of polyfunctional crosslinkable monomers include pentaerythritol triacrylate, trimethylol ethane triacrylate, trimethylol propane triacrylate, tetramethylol methane tetraacrylate, oligoester acrylates and methacrylates, 2,2-bis(4-methacryloxy-polyethoxyphenyl) propane, diacryl phthalate, triallyl cyanurate, triallyl isocyanurate, triallyl trimellitate and diaryl chlorendate.

The added amount is preferably 0.001 to 15.000 mass parts per 100 mass parts of the polymerizable monomer.

When the medium used for suspension polymerization is an aqueous medium, the following may be used as dispersion stabilizers for the particles of the polymerizable monomer composition: tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica and alumina.

The following may also be used as organic dispersants: polyvinyl alcohol, gelatin, methyl cellulose, methyl hydroxypropyl cellulose, ethyl cellulose, carboxymethyl cellulose sodium salt, and starch.

A commercial nonionic, anionic or cationic surfactant may also be used. Examples of such surfactants include sodium dodecyl sulfate, sodium tetradecyl sulfate, sodium pentadecyl sulfate, sodium octyl sulfate, sodium oleate, sodium laurate and potassium stearate.

A colorant may also be used in the toner, and a known colorant may be used without any particular limitations.

The content of the colorant is preferably 3.0 to 15.0 mass parts per 100 mass parts of the binder resin or the polymerizable monomer for producing the binder resin.

A charge control agent may be used during toner manufacture, and a known agent may be used. The added amount of these charge control agents is preferably 0.01 to 10.00 mass parts per 100 mass parts of the binder resin or polymerizable monomer.

The toner particle may be used as is as the toner, or various organic and inorganic powders may be added as necessary to the toner particle. From the standpoint of durability when added to the toner particle, the particle diameter of such an organic or inorganic powder is preferably not more than 1/10 the weight-average particle diameter of the toner particle.

The following organic or inorganic powders may be used for example.

(1) Flowability imparting agents: silica, alumina, titanium oxide, carbon black and carbon fluoride (2) Abrasives: metal oxides (such as strontium titanate, cerium oxide, alumina, magnesium oxide and chromium oxide), nitrides (such as silicon nitride), carbonates (such as silicon carbonate) and metal salts (such as calcium sulfate, barium sulfate and calcium carbonate)

(3) Lubricants: fluorine resin powders (such as vinylidene fluoride and polytetrafluoroethylene) and fatty acid metal salts (such as zinc stearate and calcium stearate)

(4) Charge control particles: metal oxides (such as tin oxide, titanium oxide, zinc oxide, silica and alumina) and carbon black The toner may also be surface treated with an organic or inorganic fine powder to improve flowability or charge uniformity. Examples of organic or inorganic fine powders as hydrophobic treatment agents include unmodified silicone varnish, various kinds of modified silicone varnish, unmodified silicone oil, various kinds of modified silicone oil, silane compounds, silane coupling agents, other organosilicon compounds and organic titanium compounds. One of these treatment agents alone or a combination of multiple kinds may be used.

The various measurement methods in the present invention are explained below.

Method for Observing Toner Cross-section with Scanning Transmission Electron Microscope (STEM)

A toner cross-section for observation with a scanning transmission electron microscope (STEM) is prepared as follows.

The procedures for preparing the toner cross-section are explained below.

First, the toner is spread as a single layer on a cover glass (Matsunami Glass Ind., Ltd., square cover glass No. 1) and given an Os film (5 nm) and naphthalene film (20 nm) as protective films using an osmium plasma coater (Filgen, Inc., OPC80T).

Next, a PTFE tube (Φ 1.5 mm×Φ 3 mm×3 mm) is filled with D800 photocurable resin (JEOL Ltd.), and the previous cover glass is set carefully on the tube so that the toner is brought into contact with the D800 photocurable resin. This is exposed to light in this state to cure the resin, after which the cover glass is removed to form a resin cylinder with the toner enveloped in the outermost surface of the resin.

The resin cylinder is then cut at a cutting rate of 0.6 mm/s with an ultrasonic ultramicrotome (Leica, UC7) at exactly half the diameter of the toner (such as 4.0 μm if the weight-average particle diameter (D4) is 8.0 μm) from the outermost surface of the resin to expose a cross-section of the toner center.

This is then cut to a thickness of 100 nm to prepare a thin sample of the toner cross-section. A cross-section of the toner center can be obtained by cutting by such methods.

Images are obtained with a STEM probe size of 1 nm and an image size of 1,024×1,024 pixels. Images are obtained with the Contrast adjusted to 1,425 and the Brightness to 3,750 on the bright field image Detector Control panel and the Contrast adjusted to 0.0, the Brightness to 0.5 and the Gamma to 1.00 on the Image Control panel. The image magnification is 100,000×, and image capture is performed so that about one-fourth to one-half of the circumference of the cross-section of one toner particle is contained as shown in FIG. 4.

The resulting image is subjected to image analysis using "Image J" image processing software (obtainable from https://imagej.nih.gov/ij/), and the protrusions containing the organosilicon polymer are measured. Image analysis is performed on 30 STEM images.

First, the line drawing tool (select Segmented line of Straight tab) is used to draw a line tracing the circumference of the toner base particle. In places where the protrusions of the organic silicon polymer are buried in the toner base particle, the line is continued smoothly as if there were no burial.

The image is converted to a flat image based on this line (choose Selection in Edit tab, change line width to 500 pixels in properties, then choose Selection in Edit tab and run Straightener). For this flat image, the protrusion width w, protrusion diameter d and protrusion height h are measured by the above methods for each protrusion containing the organosilicon polymer. The P(d/w) is calculated from the results from 30 measured STEM images. The cumulative distribution of protrusion height h is also taken and the h80 is calculated.

Σw is given as the total value of the protrusion widths w of protrusions with a height h of at least 40 nm and not more than 300 nm in the flat image used for image analysis, and the width of the flat image used for image analysis is given as the perimeter length L. The width of this flat image corresponds to the length of the toner base particle surface in the STEM image. Ew/L is calculated for each image, and the arithmetic mean of 30 STEM images is adopted.

Detailed measurement of the protrusions is as explained above and as shown in FIGS. 5 to 7.

Measurement is performed with the Image J software after overlaying the scale on the image with Straight Line on the Straight tab, and setting the length of the scale on the image with Set Scale on the Analyze tab. A line segment corresponding to the protrusion width w or protrusion height h can be drawn with Straight Line on the Straight tab and measured with Measure on the Analyze tab.

Method for Calculating Average Particle Diameter of Protrusions under Scanning Electron Microscope (SEM)

SEM observation is performed as follows using images taken with a Hitachi S-4800 ultrahigh resolution field emission scanning electron microscope (Hitachi High Technologies Corporation). The imaging conditions for the S-4800 are as follows.

(1) Sample Preparation

A conductive paste (TED PELLA, Inc., Product No. 16053, PELCO Colloidal Graphite, Isopropanol base) is thinly coated on a sample stand (15 mm×6 mm aluminum sample stand), and the toner is blown onto the paste. Air is then blown to remove excess fine particles from the sample stand, after which platinum deposition is performed for 15 seconds at 15 mA. The sample stand is set in a sample holder, and the sample stand height is adjusted to 30 mm with a sample height gauge.

(2) Setting S-4800 Observation Conditions

Liquid nitrogen is injected to overflowing into an anti-contamination trap attached to the housing of the S-4800 and left for 30 minutes. "PC-SEM" is operated on the S-4800 to perform flushing (purification of FE chip electron source). The acceleration voltage display part of the control panel on the image is clicked, and the "Flushing" button is pressed to open a flushing execution dialog. This is executed after the flushing strength is confirmed to be 2. The emission current from flushing is then confirmed to be 20 to 40 μA. The sample holder is inserted into the sample chamber of the S-4800 housing. "Origin" is pressed on the control panel to transfer the sample holder to the observation position.

The acceleration voltage display part is clicked to open an HV setting dialog, and the acceleration voltage is set to "2.0 kV" and the emission current to "10 μA". In the "Basic" tab of the operation panel, the signal selection is set to "SE" and "Lower (L)" is selected as the SE detector to establish the observation mode for the backscattered electron image. In the same "Basic" tab of the operation panel, the probe current of the electronic optical system condition block is set to "Normal", the focus mode to "UHR", and WD to "8.0 mm". The "ON" button of the acceleration voltage display part on the control panel is pressed to apply acceleration voltage.

(3) Focus Adjustment

The magnification is set to 5,000×(5 k) by dragging within the magnification display part of the control panel. The "COARSE" focus knob of the operations panel is turned, and once a certain focus is achieved the aperture alignment is adjusted. "Align" is clicked on the control panel to open an alignment dialog, and "Beam" is selected. The STIGMA/ALIGNMENT knobs (X, Y) on the operations panel are turned to move the displayed beam to the center of the concentric circles.

"Aperture" is then selected, and the STIGMA/ALIGNMENT knobs (X, Y) are turned one at a time until image movement stops or is minimized. The aperture dialog is closed, and the device is focused with the autofocus. This operation is repeated twice more to focus the device. With the center of the maximum diameter of the observed particle aligned with the center of the measurement screen, the magnification is set to 10,000×(10 k) by dragging within the magnification display part of the control panel. The "COARSE" focus knob of the operations panel is turned, and once a certain focus is achieved the aperture alignment is adjusted. "Align" is clicked on the control panel to open an alignment dialog, and "Beam" is selected. The STIGMA/ALIGNMENT knobs (X, Y) on the operations panel are turned to move the displayed beam to the center of the concentric circles.

"Aperture" is then selected, and the STIGMA/ALIGNMENT knobs (X, Y) are turned one at a time until image movement stops or is minimized. The aperture dialog is closed, and the device is focused with the autofocus. The magnification is then set to 50,000×(50 k), the focus is adjusted as before using the focus knob and STIGMA/ALIGNMENT knobs, and the device is focused again in autofocus. These operations are repeated again to focus the device.

(4) Image Storage

Brightness is adjusted in ABC mode, and 640×480-pixel photographs are taken and stored.

The number-average diameter (D1) of 500 protrusions of at least 20 nm on the toner particle surface was calculated with the image processing software (Image J) from the resulting SEM image. The measurement methods are as follows.

Measuring Number-Average Diameter of Protrusions of Organic Silicon Polymer

Using particle analysis, the protrusions and toner base particles in the images are binarized and color coded. The maximum length of the selected shape is then selected from the measurement commands, and the protrusion diameter R (maximum diameter) of one protrusion is measured. This operation is performed multiple times, and the arithmetic mean of 500 locations is determined to calculate the number average of the protrusion diameters R.

Method for Measuring Fixing Rate of Organic Silicon Polymer 160 g of sucrose (Kishida Chemical Co., Ltd.) is added to 100 ml of ion exchange water and dissolved while boiling the water to prepare a concentrated sucrose solution. 31 g of this concentrated sucrose solution and 6 ml of Contaminon N (a 10 mass % aqueous solution of a pH 7 neutral detergent for washing precision measurement equipment, comprising a nonionic surfactant, an anionic surfactant and an organic builder, made by Wako Pure Chemical Industries, Ltd.) are placed in a centrifuge tube (capacity 50 ml) to prepare a dispersion. 1.0 g of the toner is added to this dispersion, and toner lumps are broken up with a spatula or the like.

The centrifuge tube is shaken for 20 minutes in a shaker at 350 spm (strokes per minute). After being shaken, the solution is transferred to a glass tube for a swing rotor (capacity 50 ml) and separated under conditions of 30 minutes at 3,500 rpm with a centrifuge (H-9R, Kokusan Co., Ltd.). Thorough separation of the toner from the aqueous solution is confirmed visually, and the toner separated in the uppermost layer is collected with a spatula or the like. The aqueous solution containing the collected toner is filtered with a vacuum filter and dried for at least one hour in a dryer. The dried product is broken up with a spatula, and the amount of silicon is measured by fluorescence X-ray. The fixing rate (%) is then calculated from the element ratios of the measured elements in the washed toner and the initial toner.

Fluorescence X-ray measurement of each element is performed in accordance with JIS K0119-1969, specifically as follows.

As the measurement equipment, an Axios wavelength dispersive X-ray fluorescence spectrometer (Panalytical Co.) is used together with the dedicated SuperQ ver. 4.0 F software (Panalytical Co.) for setting the measurement conditions and analyzing the measurement data. Rh is used for the anode of the X-ray tube and vacuum as the measurement atmosphere, with a measurement diameter (collimator mask diameter) of 10 mm and a measurement time of 10 seconds. Detection is performed with a proportional counter (PC) when measuring light elements and with a scintillation counter (SC) when measuring heavy elements.

About 1 g of the washed toner and initial toner is placed in a dedicated aluminum pressing ring 10 mm in diameter, spread flat, and pressed for 60 seconds at 20 MPa with a BRE-32 tablet press (Maekawa Testing Machine Mfg. Co., Ltd.) to mold a roughly 2 mm-thick pellet for use as a measurement sample.

Measurement is performed under the above conditions, the elements are identified based on the peak positions in the resulting X-ray, and their concentrations are calculated from the count rate (unit: cps), which is the number of X-ray photons per unit time.

To quantify the elements in the toner, in the case of silicon for example silica ($SiO_2$) powder is added in the amount of 0.5 mass parts per 100 mass parts of the toner particle, and thoroughly mixed with a coffee mill. Similarly, silica powder is also added and mixed with the toner particle in the amounts of 2.0 mass parts and 5.0 mass parts, and these samples are used to prepare a calibration curve.

Sample pellets for the calibration curve are prepared from each of these samples using a tablet press as described above, and the count rate (unit: cps) of Si-K$\alpha$ rays observed at a diffraction angle (2$\theta$) of 109.08° using PET as the spectral crystal is measured. During this process, the acceleration voltage and current value of the X-ray generating device are 24 kV and 100 mA, respectively. A linear function calibration curve is obtained by plotting the resulting X-ray count rate on the vertical axis and the added amount of $SiO_2$ in each calibration curve sample on the horizontal axis.

Next, the toner to be analyzed is made into a pellet with a tablet press as described above, and the count rate of Si-Ka rays is measured. The content of the organic silicon polymer in the toner is then determined from the above calibration curve. The ratio of the elemental amount in the washed toner to the elemental amount in the initial toner as calculated by the above methods is given as the fixing rate (%).

Toner T Manufacturing Example

The present invention is explained in detail below using a toner T manufacturing example, but the invention is not limited to this manufacturing example. Unless otherwise specified, "parts" of each material in the manufacturing example are all based on mass.

Toner T Manufacturing Example

Aqueous Medium 1 Preparation Step 14.0 parts of sodium phosphate (Rasa Industries, Ltd. 12-hydrate) were added to 650.0 parts of ion exchange water in a reaction vessel equipped with a stirrer, a thermometer and a return pipe, and maintained for 1.0 hours at 65° C. as the system was purged with nitrogen.

The mixture was stirred at 15,000 rpm with a T. K. Homomixer (Tokushu Kika Kogyo Co. Ltd.) as a calcium chloride aqueous solution comprising 9.2 parts of calcium chloride (dihydrate) in 10.0 parts of ion exchange water was added all at once to prepare an aqueous medium containing a dispersion stabilizer. 10 mass % of hydrochloric acid was further added to the aqueous medium to adjust the pH to 5.0 and obtain an aqueous medium 1.

Polymerizabie Monomer Composition Preparation Step

Styrene: 60.0 pts

C.I. pigment blue 15:3: 6.5 pts

These materials were placed in an attritor (Mitsui Miike Kakoki K. K.), and dispersed for 5.0 hours at 220 rpm with zirconia beads 1.7 mm in diameter to prepare a pigment dispersion. The following materials were added to this pigment dispersion.

Styrene: 20.0 pts n-butyl acrylate: 20.0 pts

Crosslinking agent (divinyl benzene): 0.3 pts

Saturated polyester resin: 5.0 pts (polycondensate of propylene oxide modified bisphenol A (2-mol adduct) and terephthalic acid (mole ratio 10:12), glass transition temperature Tg=68° C., weight-average molecular weight Mw=10,000, Molecular weight distribution Mw/Mn=5.12)

Fischer-Tropsch wax (melting point 78° C.): 7.0 pts

These were maintained at 65° C., and uniformly dissolved and dispersed at 500 rpm with a T. K. Homomixer (Tokushu Kika Kogyo Co. Ltd.) to prepare a polymerizable monomer composition.

Granulation Step

The temperature of the aqueous medium 1 was maintained at 70° C. and the rotation of the T. K. Homomixer at 15,000 rpm as the polymerizable monomer composition was added to the aqueous medium 1, and 10.0 parts of t-butyl peroxypivalate were added as a polymerization initiator. This was then granulated as is for 10 minutes with the rotation maintained at 15,000 rpm with the stirrer.

Polymerization and Distillation Step

Following the granulation step, the stirrer was replaced with a propeller stirring blade, and the mixture was stirred at 150 rpm as polymerization reaction was performed by polymerizing for 5.0 hours with the temperature maintained at 70° C. and then raising the temperature to 85° C. and heating for 2.0 hours.

Next, the return pipe of the reactor was replaced with a cooling pipe, and the slurry was heated to 100° C. and distilled for 6 hours to remove unreacted polymerizable monomer and obtain a toner base particle dispersion.

Polymerization of Organosilicon Compound 60.0 parts of ion exchange water were measured into a reaction vessel equipped with a stirrer and a thermometer, and the pH was adjusted to 4.0 with 10 mass % hydrochloric acid. This was heated under stirring, to a temperature of 40° C. 40.0 parts of the organosilicon compound methyl triethoxysilane were then added, and hydrolysis was performed under stirring for at least 2 hours. Completion of hydrolysis was confirmed visually when the oil and water formed one layer without separating, at which point the mixture was cooled to obtain a hydrolysis solution of the organosilicon compound.

The toner base particle dispersion obtained above was cooled to 55° C., and 25.0 parts of the hydrolysis solution of the organosilicon compound were added to initiate polymerization of the organosilicon compound. This was maintained as is for 15 minutes, after which the pH was adjusted to 5.5 with 3.0% sodium hydrogen carbonate aqueous solution. Stirring was continued at 55° C. and maintained for 60 minutes, after which the pH was adjusted to 9.5 with 3.0% sodium hydrogen carbonate aqueous solution and the mixture was maintained for a further 240 minutes to obtain a toner particle dispersion.

Washing and Drying Step

After completion of the polymerization step, the toner particle dispersion was cooled, adjusted to a pH of not more than 1.5 by addition of hydrochloric acid, left for one hour under stirring, and then subjected to solid-liquid separation in a pressure filter to obtain a toner cake. This was re-slurried with ion exchange water to again obtain a dispersion, which was then subjected to solid-liquid separation in the same filter to obtain a toner cake.

The resulting toner cake was dried for 72 hours in a 40° C. thermostatic tank and classified to obtain a toner particle T.

When a toner T prepared as described above was placed in the developing apparatus 7 of this example, the toner T became negatively charged.

Work Function of Toner

The work function (Φ) of the toner was measured with a photoelectron spectroscope (Riken Keiki Co., Ltd., AC-2) in the same way as the material used in the seal sheet 4.

The results showed that the toner had a work function of 5.53 eV.

Toner Purge Sequence

In this example, toner is supplied periodically to the cleaning blade 3 in order to impart lubricity to the cleaning blade 3.

To this end, the toner purge sequence for supplying toner from the developing apparatus 7 to the cleaning apparatus 2 in the image forming apparatus 200 is set to operate after every specific number of printed pages.

In the toner purge sequence of this example, a non-image-forming interval is provided for every 100 printed sheets, in which image formation is interrupted and the toner purge sequence is activated during that interval. For each toner purge sequence, a horizontal band pattern is drawn having a width of 15 mm in the rotation direction of the photosensitive drum 1 (direction of arrow A in FIG. 1 and the like), and the toner is developed on the photosensitive drum 1. −200 V of transfer bias is then applied to the transfer roller 11 so that the toner will not be transferred to the transfer roller 11, and the toner is supplied to the cleaning apparatus 2.

Toner is thus supplied periodically to the cleaning apparatus 2.

Drive Torque

Measurement of the drive torque of the photosensitive drum 1 in this example is explained next.

In this measurement, a rotating jig with an attached torque measuring device for measuring the drive torque of the photosensitive drum 1 was connected to the frame of the cleaning apparatus 2 with the photosensitive drum 1, the cleaning blade 3 and the seal sheet 4 mounted on the cleaning apparatus 2. Presupposing a supply of toner to the cleaning apparatus 2 by the toner purge sequence, a photosensitive drum 1 was used having a solid horizontal band image formed across the axial range for 15 mm in the rotation direction of the photosensitive drum 1 upstream from the seal sheet 4.

As a result, the drive torque of the photosensitive drum 1 five seconds after the start of rotation was 1.74 kgf cm when using a cleaning apparatus 2 having a PTFE tape affixed to the surface of the seal sheet 4.

In the case of a cleaning apparatus 2 using a different material, namely a PET sheet as the seal sheet 4, the drive torque was 1.78 kgf·cm.

Explanation of Low-torque Operation

Next, the drive torque is reduced by effectively supplying protrusions of a toner having surface protrusions to the cleaning nip N1 in the cleaning apparatus 2 of this embodiment. The mechanism for this is explained in detail using FIGS. 8A and 8B.

Figure 8A:
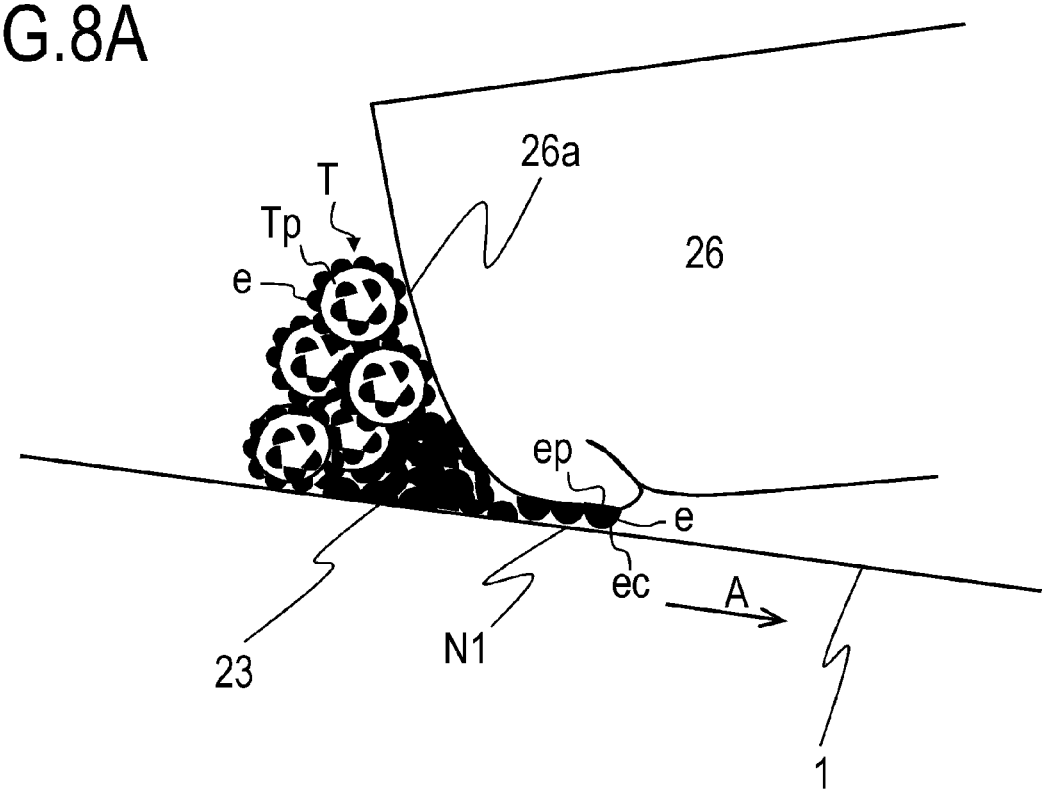
FIGS. 8A and 8B are enlarged views of a contact part between a photosensitive drum and a cleaning member in Example 1.

FIG. 8A is a schematic view showing the condition near the cleaning nip N1 when toner T (residual toner) that has remained on the photosensitive drum 1 without being transferred is cleaned by the cleaning part 26.

The toner (developer) T comprises a toner base particle Tp together with multiple protrusions e formed on the surface of the toner base particle Tp.

Toner T (residual toner) that has remained on the photosensitive drum 1 without being transferred to the recording material 12 passes through contact part N2 between the seal sheet 4 and the photosensitive drum 1 to reach the cleaning part 26. Toner T arriving at the cleaning part 26 rubs against the cleaning part 26, and at least some of the protrusions e formed on the surface of the toner T transfer from the toner base particle Tp to the cleaning part 26. Some of the transferring protrusions e are then transported to the cleaning nip N1 under pressure from other protrusions e that have transported to the cleaning part 26, and the flat parts ep of these protrusions e attach to the side of the cleaning part 26. Protrusions e that have been unable to enter the cleaning nip N1 accumulate near the entrance to the cleaning nip N1, forming a deposition layer 23 of protrusions e.

Figure 8B:
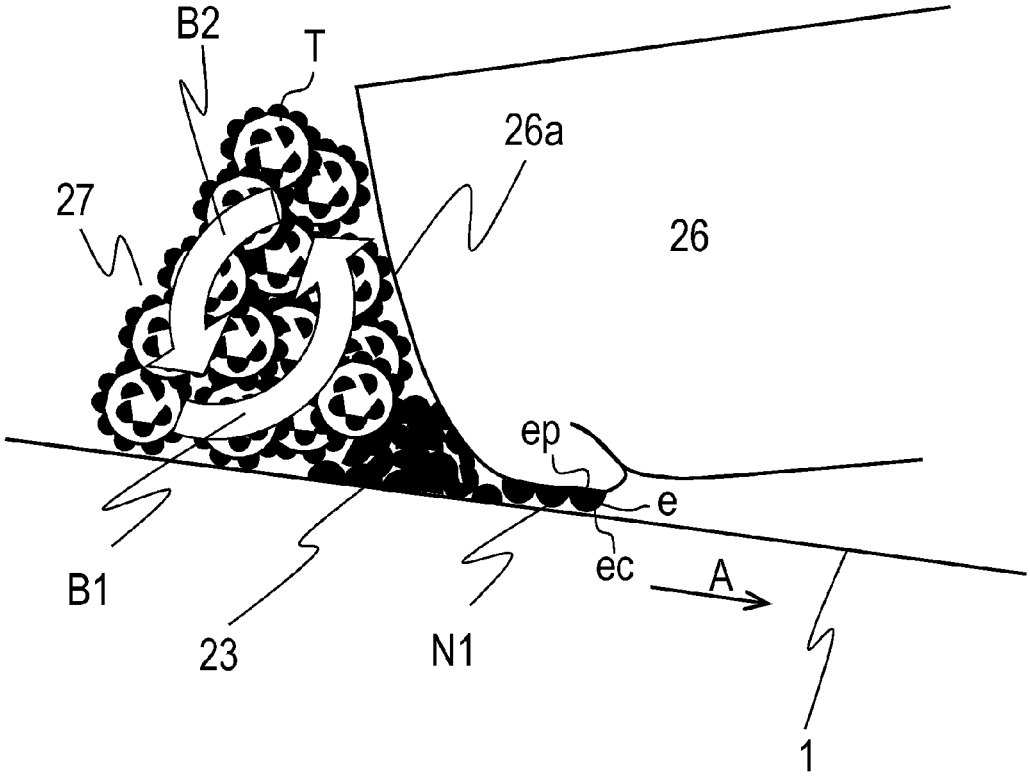

Once the deposition layer 23 has formed, as shown in FIG. 8B, toner T (residual toner) that has remained on the photosensitive drum 1 without being transferred runs up against the deposition layer 23. This is then pushed upwards in the direction of arrow B1 by the circulation of toner T pressing continuously from behind (from upstream in the direction of movement of the photosensitive drum 1). The toner T that is pushed upwards then moves by gravity in the direction of arrow B2. This causes circulation of the toner T from arrow B1 to arrow B2 in region 27. At this time the toner T rubs against cut the surface 26*a* and other toner T particles, so that the protrusions e formed on the surface of the toner T transfer to the surface of other toner T particles or to the deposition layer 23.

However, the toner T also rubs against the seal sheet 4 before reaching the cleaning nip N1. In this example, the seal sheet 4 is made of either (i) a material (PTFE) having a greater work function than the toner T or (ii) a material (PET) having almost the same work function as the toner T.

When (i) PTFE is used for the seal sheet 4, the material is such that the toner T is charged positively when the toner T and PTFE rub together. Consequently, when the toner T rubs against the seal sheet 4 as it passes through the contact part N2 between the photosensitive drum 1 and the seal sheet 4, the toner charge moves towards the positive side. Because the toner T is negatively charged before passing through the contact part N2 between the photosensitive drum 1 and the seal sheet 4, its charge quantity is reduced when its charge moves to the positive side due to rubbing with the seal sheet 4. The electrostatic adhesion force of the toner T is weakened as a result, and its flowability is improved.

When (ii) PET is used for the seal sheet 4, there is little change in the flowability of the toner T because there is little change in the charge of the toner T even when the toner T and the seal sheet 4 rub together.

Because the flowability of the toner T has not deteriorated by the time it reaches the region 27, the toner T moves easily and there are more chances for the toner T to rub against the cut surface 26*a* or other toner particles, thereby increasing the amount of protrusions e that transfer from the surface of the toner T to other toner T particles, or to the cleaning part 26, or to the deposition layer 23. It is thus possible to supply many of the transferring protrusions e to the cleaning nip N1.

As shown in FIGS. 8A and 8B, with the toner T used in this example the protrusions e that transfer to other toner T particles or to the cleaning part 26 or to the deposition layer 23 have flat parts ep and curved parts ec, and in the case of those transferring protrusions e that enter the cleaning nip N1, the flat parts ep of the protrusions e attach to the side of the cleaning part 26. As a result, the curved parts ec of the protrusions e come into contact with the photosensitive drum 1, reducing the contact area between the cleaning blade 3 and the photosensitive drum 1. The cleaning blade 3 and the surface of the photosensitive drum 1 slide more easily as a result, allowing the drive torque of the photosensitive drum 1 to be reduced.

In addition to functioning as a developer in image formation (development of latent images), the toner T used in this embodiment also functions as a composite particle (intervening particle) that confers lubricity in the area of contact between the photosensitive drum 1 and the cleaning blade 3. That is, the toner T exists as composite particles (intervening particles) in the region 27, which is an adjacent region that adjoins the area of contact between the photosensitive drum 1 and the cleaning blade 3 upstream in the direction of rotation of the photosensitive drum 1. The drive torque of the photosensitive drum 1 can then be reduced by the aforementioned lubricating function of the "protrusions e" that are transported from the toner T base particles to the area of contact by the rotation of the photosensitive drum 1.

Apart from this embodiment, a toner as a composite particle for lubrication can also be prepared separately from the toner as a developer for image formation (latent image development), or in other words different kinds of dedicated particles (toners) can also be configured specially for each function. The composite particle for lubrication may be a lubricant having a first particle containing a base particle and an organic silicon polymer on the surface of the base particle like the toner for development.

The method for supplying the toner as a composite particle to the apparatus is not particularly limited. For example, it may be a method of storing the composite particle in advance in the toner storage container 5. That is, the composite particle may be stored in advance in a separate location from the developing toner when the apparatus is manufactured, and then supplied to the location where it confers the desired lubricity when the apparatus is operated.

Comparative Example 1

A material having a smaller work function than the toner T or in other words a material that charges the toner T negatively when it rubs against the toner T was used for the seal sheet 4 in Comparative Example 1. Specifically, a sheet comprising nylon tape (3M Company, product number 2756) affixed to the surface of a PET sheet (Toray Industries, Inc., Lumirror®) was used. The surface having the affixed nylon tape was brought into contact with the photosensitive drum 1.

The work function (Φ) of the seal sheet 4 was measured using the same photoelectron spectroscope (Riken Keiki Co., Ltd., AC-2) as in the Example 1. The results showed that the work function of the nylon tape was 5.20 eV.

The drive torque of the photosensitive drum 1 was also measured by the same methods as in the Example 1. As a result, the drive torque in a cleaning apparatus 2 comprising nylon tape affixed to the surface of the seal sheet 4 was 2.13 kgf·cm.

Thus, when a material that negative charges the toner T or in other words a material having a smaller work function than the toner T is used as the material of the seal sheet 4, the charge of the toner T changes as follows. That is, when the toner T passes through the contact part N2 between the photosensitive drum 1 and the seal sheet 4, its charge moves towards the negative side due to rubbing with the seal sheet 4. Because the toner T is already negatively charged before passing through the contact part N2 between the photosensitive drum 1 and the seal sheet 4, its charge quantity is increased when its charge moves further to the negative side due to rubbing with the seal sheet 4. The electrostatic adhesion force of the toner T is reinforced as a result, and the flowability of the toner T deteriorates. Because the toner T has a large negative charge, moreover, the toner T particles aggregate even after reaching the region 27, constricting the movement of the toner T near the region 27 and reducing opportunities for rubbing between the toner T and the cut surface 26*a* and other toner T particles. This makes it more difficult for the protrusions e to transfer from the toner base particle Tp to the toner T, the cleaning part 26 or the deposition layer, thereby reducing the amount of the transferring protrusions e that are supplied to the cleaning nip N1. The amount of the transferring protrusions e that adhere to the side of the cleaning part 26 is reduced as a result, making it more difficult for the cleaning blade 3 and the surface of the photosensitive drum 1 to slide against each other. The drive torque of the photosensitive drum 1 is increased as a result.

Comparative Example 2

In another comparative example, Comparative Example 2, a toner having no surface protrusions e was used as the toner, the materials used for the seal sheet 4 were the same as in Example 1, Example 2 and Comparative Example 1, and the drive torque of the photosensitive drum 1 was measured.

One of the materials used for the seal sheet 4 was a sheet comprising PTFE tape (3M Company, PTFE tape, product number 5490) affixed to the surface of a PET sheet (Toray Industries, Inc., Lumirror®). A PET sheet (Toray Industries, Inc., Lumirror®) and a sheet comprising nylon tape (3M Company, product number 2756) affixed to the surface of a PET sheet (Toray Industries, Inc., Lumirror®) were also used.

When the drive torque of the photosensitive drum 1 was measured in the same way using these materials, the torque was 2.94 kgf·cm using the PTFE tape, 3.09 kgf·cm using the PET sheet, and 3.04 kgf·cm using the nylon tape.

Thus, even if a toner having no surface protrusions e reaches the deposition layer 23 and an external additive detaches from the toner base particle Tp and enters the cleaning nip N1, little of the external additive attaches to the cleaning part 26 because the external additive lacks flat parts. The external additive is then removed from the cleaning part 26 by the movement of the photosensitive drum 1. Thus, the cleaning blade 3 and the surface of the photosensitive drum 1 cannot slide easily together, and the drive torque of the photosensitive drum 1 is increased.

As discussed above, in an image forming apparatus using a toner T having surface protrusions e and a negative regular charging polarity, the work function of the material used for the seal sheet 4 is (i) greater than the work function of the toner T or (ii) not much different from the work function of the toner T.

This means that when the toner passes through the contact part N2 between the photosensitive drum 1 and the seal sheet 4, even if the toner T and the seal sheet 4 rub together the toner T is either neutralized or maintains its charge, and thus the toner T acquires very little additional minus charge. Consequently, the electrostatic adhesion force of the toner T does not increase, and its flowability does not deteriorate. When the toner T then reaches the region 27, because the toner T has maintained flowability it has many opportunities to rub against the cut surface 26*a* and other particles of the toner T, increasing the amount of the protrusions e that transfer from the toner T surface to the toner T or to the cleaning part 26 or to the deposition layer or the like. It is thus possible to supply many transferring protrusions to the cleaning nip N1.

In the toner T used in this example, the protrusions e that transfer to the toner T or the cleaning part 26 or to the deposition layer or the like have flat parts ep and curved parts ec, and in the case of those transferring protrusions e that enter the cleaning nip N1, the flat parts ep of the protrusions e attach to the side of the cleaning part 26. This reduces the contact area between the cleaning blade 3 and the photosensitive drum 1 because the flat parts ec of the protrusions e come into contact with the photosensitive drum 1. The cleaning blade 3 and the surface of the photosensitive drum 1 slide more easily as a result, allowing the drive torque of the photosensitive drum 1 to be reduced.

In this example, moreover, a PET sheet was used as an example having (ii) a small difference in work function between the toner T and the seal sheet 4, but this example is not limiting. For example, as long as the work function difference between the toner and the seal sheet 4 is within 0.15 eV, it is thought that little charge is imparted due to rubbing, and toner flowability is maintained.

Moreover, although the explanations in this example pertain to a toner having a negative regular charging polarity, this example is not limiting, and with a toner having a positive regular charging polarity, the work function value of the seal sheet 4 is reduced relative to the work function value of the toner. As a result, rubbing between the seal sheet 4 and the toner imparts a negative charge to the positively charged toner, reducing the charge quantity of the toner. The electrostatic adhesion force of the toner is weakened as a result, toner flowability is improved, and it is easier for the protrusions e on the toner surface to migrate to the toner, to the cleaning part 26 and to the deposition layer. It is thus possible to supply the toner protrusions e to the cleaning nip N1, where the flat parts ep of the protrusions e attach to the side of the cleaning part 26. The drive torque of the photosensitive drum 1 is thus reduced because the contact area between the cleaning blade 3 and the photosensitive drum 1 is smaller.

Moreover, although the explanations in this example pertain to a configuration provided with a process cartridge that is detachable from the main body of the image forming apparatus 200, the applicable configurations are not limited to this in the present invention.

For example, the present invention is also applicable to a device configuration in which the cleaning apparatus is not detachable from the main body of the image forming apparatus.

Moreover, although the explanations of this example pertain to a process cartridge equipped with a charging roller 6, a developing apparatus 7 and a cleaning apparatus 2, the present invention is applicable to any process cartridge having at least a cleaning apparatus.

Example 2

Figure 9:
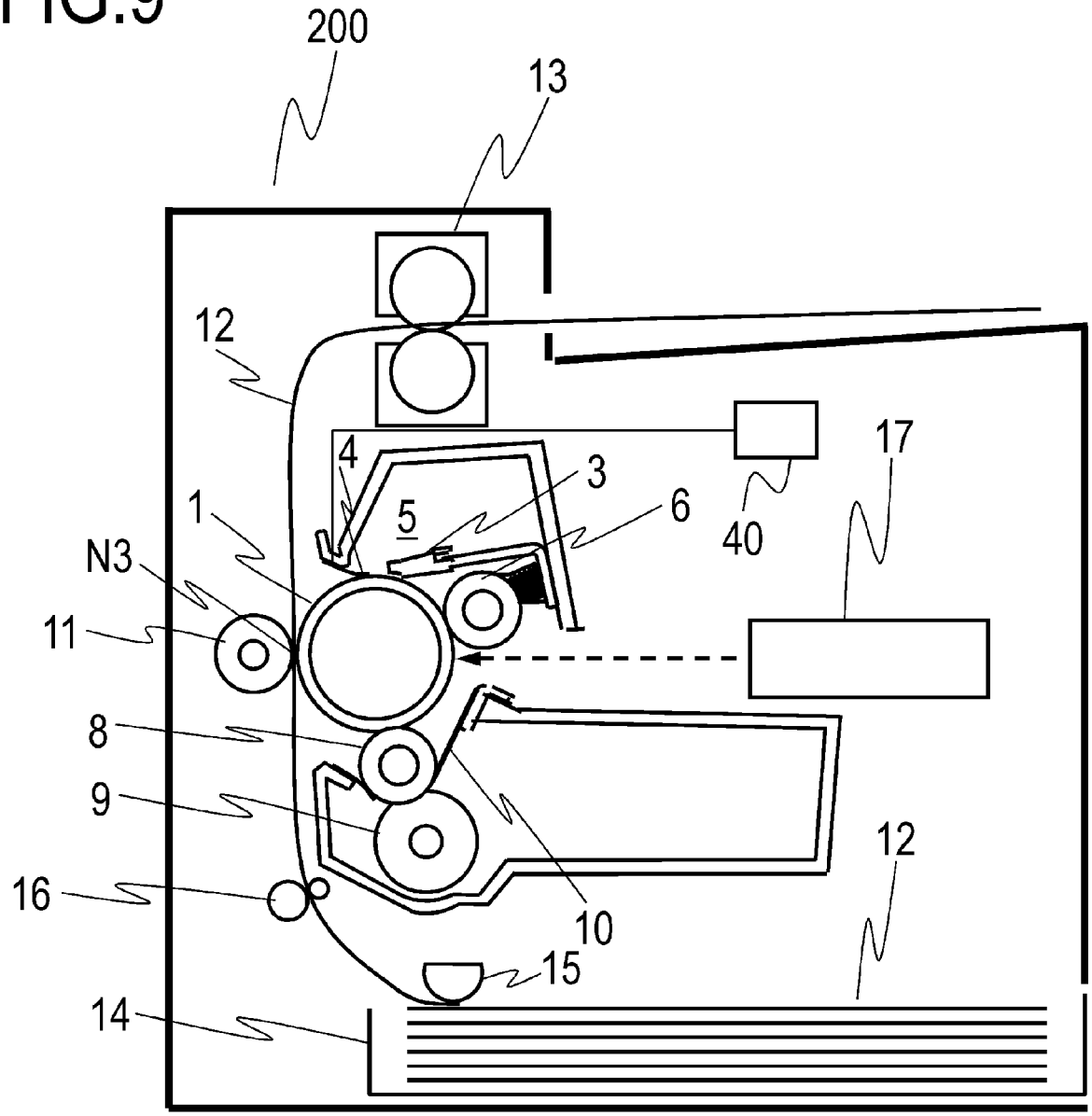
FIG. 9 is a schematic sectional view of an image forming apparatus of Example 2.

FIG. 9 is a schematic illustration of a process cartridge 100 of Example 2 of the present invention. In Example 2 of the invention, a stainless steel (SUS) sheet is used as the sheet of the seal sheet 4, and bias is applied to the SUS sheet from a high voltage power supply 40 as a voltage application means. The applied bias is bias of plus voltage (voltage having polarity opposite the charging polarity of the toner 4) or 0 V voltage bias, or in other words bias that does not increase the charge quantity of the toner 4 (bias having no magnitude on the same polarity side as the charging polarity of the toner 4).

Elements that are the same in the configurations of Example 2 and Example 1 are indicated with the same symbols, and explanations are omitted. The explanations of Example 1 are incorporated.

The image forming apparatus 200 of this example is configured like Example 1, except that the sheet used for the seal sheet 4 in the cleaning apparatus 2 is a SUS sheet. Moreover, bias is applied to the SUS sheet from a high voltage power supply 40 provided in the image forming apparatus 200 (main body of the apparatus).

The material of the sheet used for the seal sheet 4 is not limited to SUS, and another electrically conductive material may be used.

Seal Sheet, High-Voltage Bias

The seal sheet 4 that is a feature of this example and the voltage bias that is applied to the seal sheet 4 by the high voltage power supply 40 are explained next.

A SUS sheet (SUS 304, thickness 40 μm) was used as the material of the seal sheet 4 in this example.

+400 V and 0 V of DC bias (DC voltage) was applied by the high voltage power supply 40 to the seal sheet 4 as high voltage bias.

By thus forming the seal sheet 4 from a metal material and applying bias to the seal sheet 4, it is possible to neutralize the toner T and prevent an increase in the electrostatic attachment force of the toner T.

Drive Torque

Measurement of the drive torque of the photosensitive drum 1 in this example is explained next.

The drive torque of the photosensitive drum 1 was measured under similar conditions to Example 1 with +400 V or 0 V of DC bias applied to the seal sheet 4 from the high voltage power supply 40.

As a result, the drive torque of the photosensitive drum 1 was found to be 1.96 kgf·cm when +400 V of bias was applied, and 1.89 kgf·cm when 0 V of bias was applied.

Explanation of Low-torque Operation

Then, the mechanism of the drive torque in this example is explained.

As in Example 1, toner T (residual toner) that has remained on the photosensitive drum 1 without being transferred to the recording material 12 arrives at the cleaning part 26. Toner T that reaches the cleaning part 26 rubs against the cleaning part 26, and at least some of the protrusions e formed on the surface of the toner T transfer from the toner base particle Tp to the cleaning part 26. The flat parts ep of the transferring protrusions e attach to the side of the cleaning part 26, and transferring protrusions e also accumulate near the entrance to the cleaning nip N1, forming a deposition layer 23.

Once the deposition layer 23 has formed, toner T (residual toner) that has remained on the photosensitive drum 1 without being transferred runs up against the deposition layer 23 of the protrusions e, causing circulation from arrow B1 to arrow B2 in the region 27. At this time the toner T rubs against the cut surface 26*a* and other toner particles T, and the protrusions e formed on the toner surface transfer to the surface of the other toner T particles or to the deposition layer 23.

However, the toner T also rubs against the seal sheet 4 before reaching the cleaning nip N1. In this example, +400 V or 0 V of bias is applied to the seal sheet 4.

That is, when +400 V of DC bias is applied to the seal sheet 4, an electrical field forms between the photosensitive drum 1 and the seal sheet 4. When the toner T and seal sheet 4 then rub together, because the seal sheet 4 is a conductive body, the minus charge of the toner T migrates to the positive side (seal sheet 4). By contrast, because the photosensitive drum 1 is an insulating body there is almost no movement of charge from the photosensitive drum 1 to the toner T. The toner T is neutralized as a result.

When 0 V of DC bias is applied to the seal sheet 4, no field is formed between the photosensitive drum 1 and the seal sheet 4. Then when the toner T and seal sheet 4 rub together, because the seal sheet 4 is a conductive body, the pre-existing minus charge of the toner T migrates to the seal sheet 4. By contrast, because the photosensitive drum 1 is an insulating body there is almost no movement of charge from the photosensitive drum 1 to the toner T. The toner T is neutralized as a result.

Ultimately the pre-existing minus charge of the toner T migrates to the seal sheet 4, the toner is neutralized, and charge quantity of the toner T is reduced. The electrostatic attraction force of the toner T is weakened as a result, and toner T flowability is improved.

Once this toner T reaches the region 27, because the toner T has good flowability it moves easily, creating more chances for the toner T to rub against the cut surface 26*a* and other toner T particles, and causing more of the protrusions e to transfer from the toner surface to other toner T surfaces and to the deposition layer 23. It is thus possible to supply many of the transferring protrusions e to the cleaning nip N1. In the toner T used in this example, the transferring protrusions e have flat parts ep and curved parts ec, and in the case of those transferring protrusions e that enter the cleaning nip N1, the flat parts ep of the protrusions e attach to the side of the cleaning part 26. As a result, the curved parts ec of the protrusions e come into contact with the photosensitive drum 1, reducing the contact area between the cleaning blade 3 and the photosensitive drum 1. The cleaning blade 3 and the surface of the photosensitive drum 1 slide more easily as a result, allowing the drive torque of the photosensitive drum 1 to be reduced.

Comparative Example

As a comparative example, the drive torque of the photosensitive drum 1 was measured under the same conditions as in the Example 1 with −400 V of DC bias applied to the seal sheet 4 from the high voltage power supply 40.

As a result, the drive torque of the photosensitive drum 1 was 2.39 kgf·cm, meaning that like Example 2, the value of the drive torque was greater than when +400 V or 0 V of DC voltage was applied to the seal sheet 4.

This is because an electrical field forms between the photosensitive drum 1 and the seal sheet 4 when −400 V of DC bias is applied to the seal sheet 4. When the toner T and the seal sheet 4 then rub against each other, because the seal sheet 4 is a conductive body and the toner T is on the plus side compared to the seal sheet 4 in terms of potential, minus charge migrates from the seal sheet 4 to the toner T. By contrast, because the surface of the photosensitive drum 1 is an insulating body, there is almost no movement of charge from the photosensitive drum 1 to the toner T. The minus charger of the toner T increases still further as a result, the electrostatic adhesion force of the toner increases, and the flowability of the toner T deteriorates.

Because the toner T has a large negative charge, moreover, the toner T particles aggregate after reaching the region 27, constricting the movement of the toner T near the region 27 and reducing opportunities for rubbing between the toner T and the cut surface 26*a* and other toner T particles. This makes it more difficult for the protrusions e to transfer from the toner T, and fewer transferring protrusions e accumulate in the deposition layer 23. The amount of the protrusions e that are supplied to the cleaning nip N1 is reduced as a result, so that the amount of protrusions e adhering to the side of the cleaning part 26 is reduced. This makes it more difficult for the cleaning blade 3 to slide against the surface of the photosensitive drum 1, and the drive torque of the photosensitive drum 1 increases as a result.

Thus, in an image forming apparatus using a toner T having surface protrusions e, a SUS sheet is used as the sheet for the seal sheet 4, and a positive voltage or a zero voltage bias is applied to this SUS sheet from the high voltage power supply 40. This causes the toner T to be neutralized even when toner T and the seal sheet 4 rub together as the toner passes through the contact part N2 between the photosensitive drum 1 and the seal sheet 4. The electrostatic adhesion force of the toner T is weakened as a result, and its flowability is improved. Once this toner T reaches the region 27, because the toner T has improved flowability there are more chances for the toner T to rub against the cut surface 26*a* and other toner T particles, causing more of the protrusions e to transfer from the toner surface to other toner T particles and the deposition layer 23. It is thus possible to supply many of the transferring protrusions e to the cleaning nip N1. In the toner T used in this example, the transferring protrusions e have flat parts ep and curved parts ec, and in the case of those transferring protrusions e that enter the cleaning nip N1, the flat parts ep of the protrusions e attach to the side of the cleaning part 26. As a result, the curved parts ec of the protrusions e come into contact with the photosensitive drum 1, reducing the contact area between the cleaning blade 3 and the photosensitive drum 1. The cleaning blade 3 and the surface of the photosensitive drum 1 slide more easily as a result, allowing the drive torque of the photosensitive drum 1 to be reduced.

Although 0 V of bias is applied to the seal sheet 4 in this example by connecting it to the high voltage power supply 40, this example is not limiting, and it may instead be connected to the ground (GND) of the main body of the image forming apparatus 200.

Moreover, although the explanations in this example pertain to a configuration provided with a process cartridge that is detachable from the main body of the image forming apparatus 200, the applicable configurations are not limited to this in the present invention.

For example, the present invention is also applicable to a device configuration in which the cleaning apparatus is not detachable from the main body of the image forming apparatus.

Moreover, although the explanations of this example pertain to a process cartridge equipped with a charging roller 6, a developing apparatus 7 and a cleaning apparatus 2, the present invention is applicable to any process cartridge having at least a cleaning apparatus.

Example 3

Example 3 of the present invention is explained here. The process cartridge 100 and image forming apparatus 200 of this example are basically configured in the same way as the image forming apparatus 200 of Example 1 shown in FIG. 1, so elements having the same function and configuration in both examples are indicating with the same symbols, and explanations are omitted.

Some of the toner T that accumulates in the region 27 as explained in FIGS. 8A and 8B ends up in the waste toner storage container 5 as the photosensitive drum 1 is driven. Therefore, when an image with a low print percentage is printed continuously or when the photosensitive drum 1 is driven with a separation between the developing roller 8 and the photosensitive drum 1, no new toner T is supplied to the region 27. The amount of toner in the region 27 declines as a result, causing the drive torque to rise.

In this example, therefore, the cut surface 26*a* is arranged so as to prevent a reduction in the toner T contained in the region 27.

Figure 11:
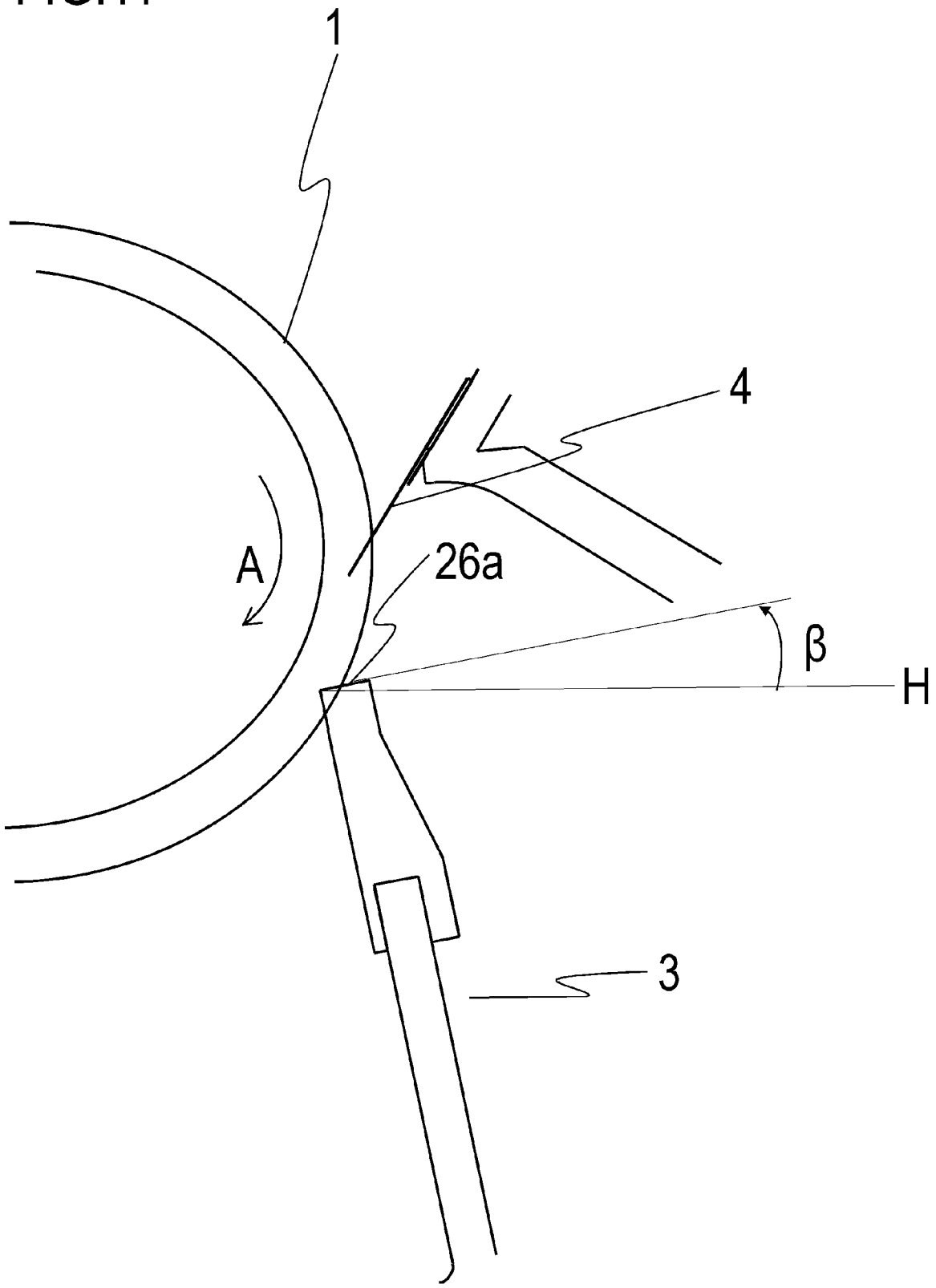
FIG. 11 is an enlarged view of a contact portion between a photosensitive drum and a cleaning member in Example 3.

Specifically, as shown in FIG. 11, the cut surface 26*a* is set horizontal or with a positive elevation (an angle that increases in height from the horizontal line H with increasing distance from the surface of the photosensitive drum 1), and preferably the angle β formed by the cut surface 26*a* and the horizontal line H is equal to or greater than the angle of repose of the toner T.

Furthermore, this example is configured with a contact/separation mechanism that separates the developing roller 8 from the photosensitive drum 1 so that the developing mechanism (developing roller 8) can be separated from the photosensitive drum 1 when the photosensitive drum 1 is rotating during non-image formation periods in order to prevent fogging of contact development.

Figure 10A:
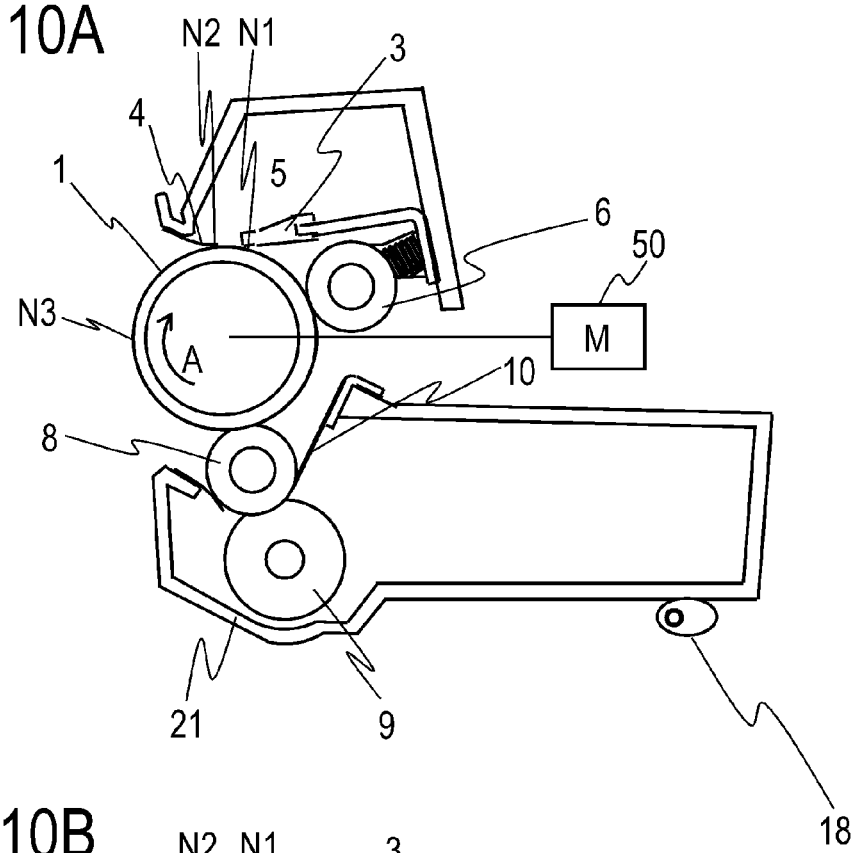
FIGS. 10A and 10B are explanatory drawings of the contact/separation mechanism of a developing means in Example 3.
Figure 10B:
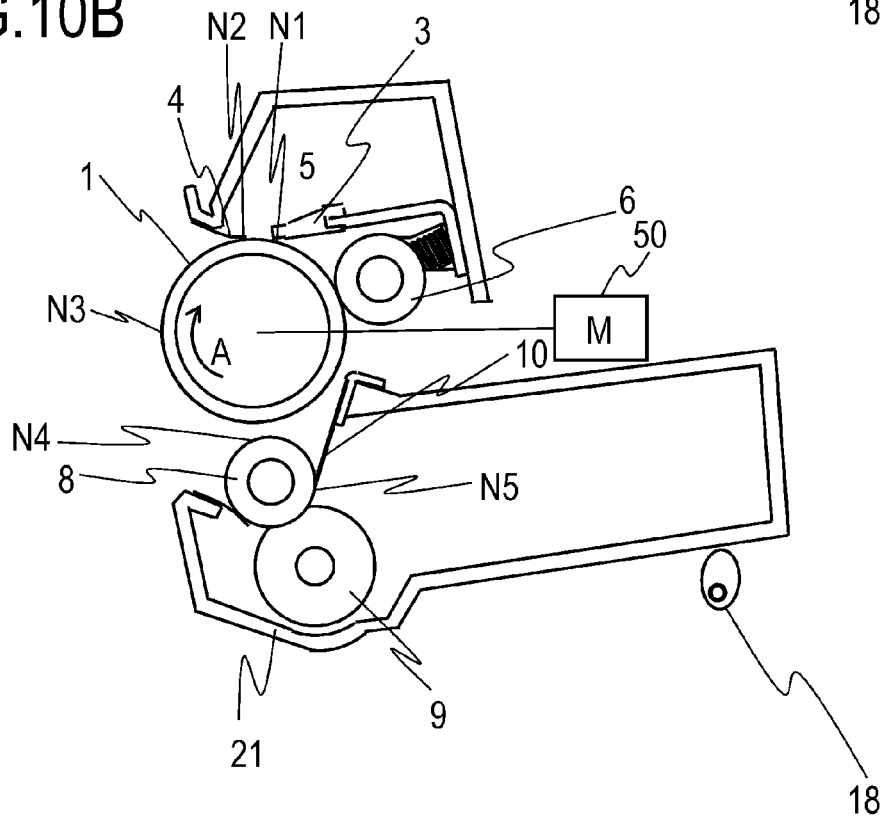

FIGS. 10A and 10B shows one example of a contact state switching means (contact/separation mechanism) for the developing roller 8. In the image forming apparatus of this example, a cam member 18 is disposed as an operating member of the contact state switching means on the main body of the apparatus in contact with a part of the frame 21 of the developing apparatus 7. The unit is configured so that the developing apparatus 7 can swing around a support shaft (not shown) relative to the main body of the apparatus in response to the rotation of this cam member 18, and the contact and separation operation (contact state and separation state) of the photosensitive drum 1 and developing roller 8 is controlled by this swinging movement of the developing apparatus 7.

FIG. 6 is a schematic cross-sectional view showing how the developing roller 8 and photosensitive drum 1 are switched between states of contact and separation by the rotation of the cam member 18, with (a) showing the contact state and (b) the separation state.

When the photosensitive drum 1 is driven with the developing roller 8 separated from the photosensitive drum 1 as shown in FIG. 10B, the drive torque of the cleaning apparatus 2 (drive torque of motor 50 for rotating photosensitive drum 1) rises, and the mechanism for this is explained below.

Mechanism for Rise in Drive Torque During Non-Image Formation

As explained in Example 1, when toner T that has accumulated in the region 27 circulates and the toner T rubs against the cleaning part 26 or other toner T, the protrusions e transfer from the toner T to the cleaning nip N1, where they reduce the torque through attachment. However, when the photosensitive drum 1 is driven with the developing roller 8 separated from the drum, no new residual toner T is supplied to the toner layer of the region 27. When the photosensitive drum 1 is driven without a supply of new residual toner T, the vibration of the cleaning part 26 as the photosensitive drum 1 is driven causes the toner T that has accumulated on the cut surface 26*a* in the region 27 to fall into the waste toner storage container 5. The amount of accumulate toner on the cut surface 26*a* in the region 27 is reduced as a result. When the amount of toner in the region 27 is reduced, the amount of protrusions e in the deposition layer 23 is also reduced, and the drive torque is increased because there are fewer protrusions e attaching to the cleaning nip N1.

The inventors of this application discovered that the rise in drive torque is greatly affected by the angle of the cut surface 26*a*, and that the reduction in the amount of accumulated toner in the region 27 due to the vibration of the cleaning part 26 could be reduced by giving the angle of the cut surface 26*a* a positive elevation relative to the horizontal plane. The experimental results are explained in detail below.

Experimental Results for Drive Torque

In this example we focused on the disposition of the cut surface 26*a*, varying the angle of the cut surface relative to the horizontal plane and evaluating the drive torque of the cleaning apparatus 2 with the developing roller 8 in a separated state. The drive torque was measured by the same methods used in Example 1, 5 seconds and 90 seconds after the start of rotation.

FIG. 11 is a schematic cross-section showing an enlarged view of the area around the contact portion between the photosensitive drum 1 and the cleaning part 26 in the cleaning apparatus 2 of this example.

Figure 12A:
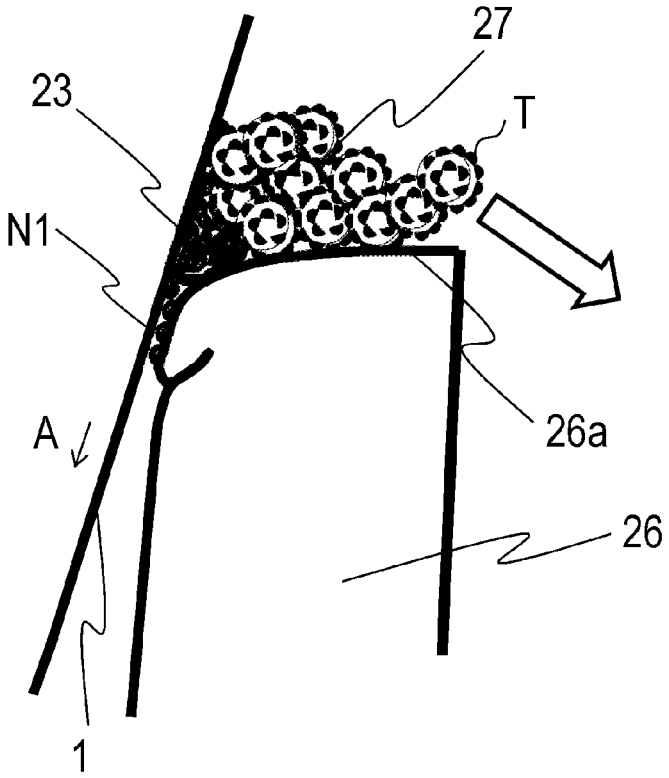
FIGS. 12A and 12B are schematic diagrams of the state near the cleaning nip N1 in Example 3.
Figure 12B:
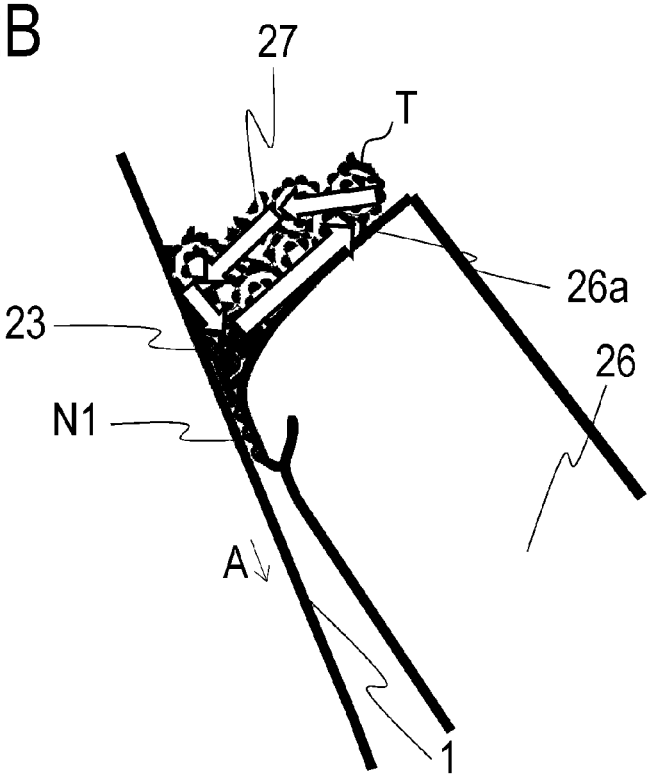

The angle β formed by the cut surface 26*a* and the horizontal line H was changed as shown in FIGS. 12A and 12B, and the drive torque was measured.

The drive torque with the angle β at a positive elevation (at least 0 degrees) was measured with the blade intrusion amount δ fixed at 0.7 mm and the blade set angle at 22°, the same conditions used in Example 1.

TABLE 1

| Angle β | −20 | −10 | 0 | 10 | 20 | 30 | 50 | 60 | 90 | 100 |
|---|---|---|---|---|---|---|---|---|---|---|
| Torque (kgf · cm) immediately after rotation | 1.7 | 1.7 | 1.7 | 1.7 | 1.7 | 1.7 | 1.7 | 1.6 | 1.5 | 1.4 |
| Torque (kgf · cm) after 90 seconds | 2.4 | 2.2 | 2.1 | 1.8 | 1.8 | 1.7 | 1.7 | 1.6 | 1.5 | 1.4 |

It can be seen from Table 1 that when the angle is positive, an increase in torque after 90 seconds can be suppressed. It is thought that this occurs because if the cut surface 26*a* has a positive elevation (an angle that increases in height from the horizontal line H with increasing distance from the surface of the photosensitive drum 1), less of the toner in the region 27 falls into the waste toner storage container 5 due to the vibration of the cleaning part 26 as the photosensitive drum 1 is driven.

The torque immediately after rotation also tends to be reduced if the angle β is at or above 50 degrees, which is the angle of repose of the toner.

FIG. 12A is a schematic diagram showing the vicinity of the cleaning nip N1 when angle β is a 0° angle, while FIG. 12B shows the vicinity of the cleaning nip N1 when angle β is a 50° angle.

Because the cleaning blade 3 is disposed with a specific blade set angle θ relative to the photosensitive drum 1, the contact position of the photosensitive drum 1 relative to the cleaning part 26 differs in FIGS. 12A and 12B.

As shown in FIG. 12B, giving the cut surface 26*a* an angle greater than the angle of repose causes the toner T near the cut surface 26*a* to move by gravity in the direction of the cleaning nip N1. This means that more of the protrusions e transfer to the deposition layer 23 due to circulation of the toner T in the toner layer of the region 27.

The toner angle of repose is explained here. The toner angle of repose is the ridge angle formed by a mountain of toner on a flat surface when the toner is deposited onto the plane surface. In this example, the angle of repose was measured with a PT-S powder tester (Hosokawa Micron Corporation). 150 g of toner is placed on a mesh of 250 μm and the mesh is vibrated to cause the toner to be deposited through a filter onto a circular table 8 cm in diameter. Enough toner is deposited so that it overflows the edges of the table. The angle formed between the surface of the circular table and the ridgeline of the deposited toner is measured to determine the angle of repose.

Although the explanations in this example pertain to a configuration having a contact/separation mechanism for separating the developing roller 8 from the photosensitive drum 1, this is not a limitation, and the present invention may also be applied to configurations in which the developing roller 8 is in constant contact with the photosensitive drum 1.

Each of the aboveexamples can be configured by combining the respective configurations as much as possible

Second Embodiment

In this embodiment, the explanations pertain to a configuration for reducing the torque at the contact portion during the interval from the time when a new photosensitive drum is driven to the time when the developer from the developing apparatus is developed on the peripheral surface of the photosensitive drum and the developer (toner) is transported to the contact portion with the cleaning blade.

Image Forming Apparatus

Because the image forming apparatus and process cartridge of this embodiment are configured as described in Example 1 (image forming apparatus), the explanations are omitted in this embodiment.

Cleaning Apparatus

Because the cleaning apparatus of this embodiment is configured as described in Example 1 (cleaning apparatus), the explanations are omitted in this embodiment.

Developer

Because the toner used as the developer constituting the "composite particle (intervening particle)" of this embodiment has the same configuration as the "toner" described in Example 1, the explanations are omitted in this embodiment.

In this embodiment, the following toner (composite particle) that functions as a lubricant is used to reduce the drive torque at the contact portion between the new photosensitive drum and the cleaning blade. Because the toner used as a lubricant can also be used as a developer, the "developer" and "lubricant" may be the same particle (composite particle). Of course, the present invention is not limited to this embodiment, and the "developer" and "lubricant" need not be the same.

That is, a particle (composite particle) that functions as a lubricant may also be contained (mixed) in advance in the developer container with the toner used (as a developer) for image formation (development of latent images).

Thus, the toner (developer) used for development may be used as a lubricant (composite particle) to impart a specific lubricating function to the rubbing parts of the cartridge, or a specialized particle used primarily for lubrication may be provided.

When a specialized particle (composite particle) is used, it may be a lubricant (composite particle) having a first particle containing a base particle and an organosilicon polymer on the surface of the base particle, similar to the "protrusions e" derived from the toner (developer) of this embodiment, which also have a lubricating function.

In this case, a composite particle (lubricant) designed primarily for lubrication can have the same effect as a composite particle consisting of a developer as in this embodiment if it is configured so that the organosilicon polymer on the surface of the base particle migrates (is supplied) from the base particle to the cleaning nip N1.

Toner T Manufacturing Example

Because the manufacturing example of the toner T of this embodiment is configured as described in Example 1 (toner T manufacturing example), the explanations are omitted in this embodiment.

Lubricant Placement Method

The lubricant placement method that is a feature of the present invention is explained with reference to FIGS. 13A to 13C. The present embodiment pertains to the lubricant placement method of FIG. 13A. However, the lubricant placement methods of FIGS. 13B and 13C are explained additionally because they are also possible lubricant placement methods.

In this embodiment the toner T is placed as a lubricant, but as discussed above, a composite particle other than the toner T may also be placed as a lubricant.

Figure 13A:
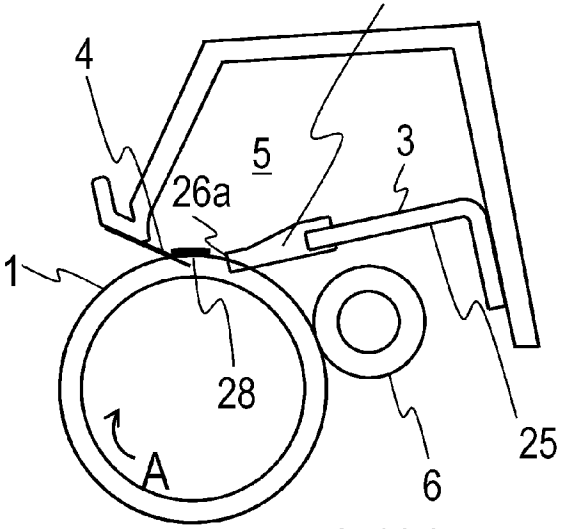
FIGS. 13A, 13B and 13C are schematic diagrams of a lubricant placement method in a second embodiment.
Figure 13C:
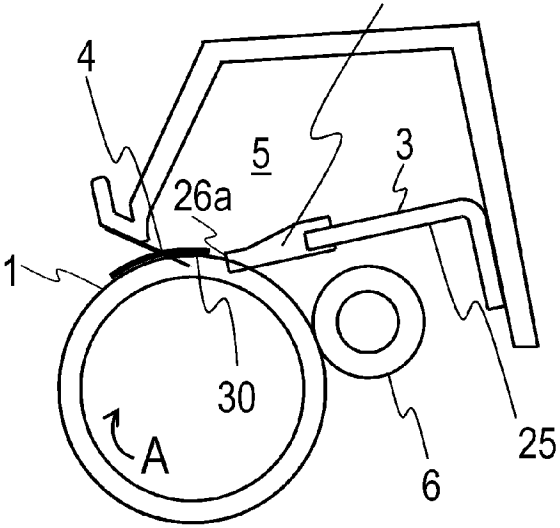
Figure 13B:
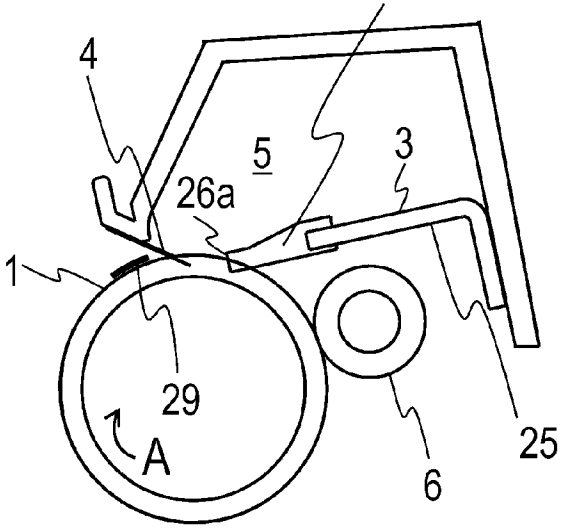

The lubricant placement method of FIG. 13A in this embodiment is explained first. The lubricant is placed on the surface of the photosensitive drum 1 when the process cartridge is manufactured, forming a lubricant area 28. This lubricant area 28 is disposed between the seal sheet 4 and the cut surface 26*a* of the cleaning blade 3. That is, in this configuration the toner T coated in advance as a lubricant on the lubricant area 28 on the peripheral surface of the photosensitive drum 1. In an alternate configuration, the lubricant area 28 may be contained in the internal space of the frame of the cleaning apparatus. In this case, when the apparatus is first driven the toner T as a lubricant that is coated on the lubricant area 28 is transported by the rotation of the photosensitive drum 1 to the contact region between the photosensitive drum 1 and the cleaning blade 3 (the adjacent region 27 before the contact area), where the protrusions e transfer to the contact region and serve a lubricating function.

When the lubricant area 28 is disposed between the cleaning blade 3 and the seal sheet 4, contamination of the charging roller 6 and the surface of the photosensitive drum 1 outside the lubricant area 28 due to lubricant scattering can be prevented because the lubricant area 28 is within the waste toner storage container 5. Because the distance between the lubricant area 28 and the cut surface 26*a* of the cleaning blade 3 is short, moreover, the lubricant is disposed on the cut surface 26*a* of the cleaning blade 3 as soon as the photosensitive drum 1 is driven, thereby reducing drive torque and reducing physical damage to the cleaning blade 3.

Because of FIG. 13B is also a possible lubricant placement example, it is additionally explained next. As in FIG. 13A, the lubricant placed on the surface of the photosensitive drum 1 forms a lubricant area 29, and this lubricant area 29 is disposed upstream in the rotation direction A of the photosensitive drum 1 from the seal sheet 4. Consequently, the amount of lubricant can be greater in FIG. 13B than in FIG. 13A. The amount of the lubricant that is transported to the cut surface 26*a* of the cleaning blade 3 is increased as a result, and a more stable lubricating effect is obtained. The position of the lubricant area 29 is upstream from the seal sheet 4 in the rotation direction A of the photosensitive drum 1, and to prevent contamination of the charging roller, it is preferably disposed before the drum is brought into contact with the charging roller 6.

In addition, FIG. 13C is explained as another possible lubricant placement example. As in FIG. 13A, the lubricant placed on the surface of the photosensitive drum 1 forms a lubricant area 30, and this lubricant area 30 is disposed upstream in the rotation direction A of the photosensitive drum 1 from the cut surface 26*a* of the cleaning blade 3. Therefore, the lubricant may be placed on the cut surface 26*a* of the cleaning blade 3 as soon as the photosensitive drum 1 is driven as in FIG. 13A, or a stable lubricating effect may be obtained if the coated amount of the lubricant can be increased as in FIG. 13B. As in FIG. 13B, considering contamination of the charging roller the lubricant area 30 in FIG. 13C is preferably positioned upstream from the seal sheet 4 in the rotation direction A of the photosensitive drum 1 and before the drum is brought into contact with the charging roller 6.

Lubricant

A toner is used as a lubricant in this embodiment. A toner as a lubricant is explained in detail below.

The toner having protrusions containing an organic silicon polymer on the toner particle surface that was explained as the "toner" of this embodiment was used as the lubricant. Regarding the detailed conditions for the toner as a lubricant, multiple toners of the embodiment and multiple toners as comparative examples were manufactured and tested for torque reduction. The various manufacturing conditions are shown in Table 2.

Manufacturing Example of Lubricant 1

Aqueous Medium 1 Preparation Step 14.0 parts of sodium phosphate (Rasa Industries, Ltd. 12-hydrate) were added to 650.0 parts of ion exchange water in a reaction vessel equipped with a stirrer, a thermometer and a return pipe, and the temperature was maintained for at 65° C. 1.0 hours as the system was purged with nitrogen.

This was stirred at 15,000 rpm with a T. K. Flomomixer (Tokushu Kika Kogyo Co. Ltd.) as a calcium chloride aqueous solution comprising 9.2 parts of calcium chloride (dihydrate) dissolved in 10.0 parts of ion exchange water was added all at once to prepare an aqueous medium containing a dispersion stabilizer. 10 mass % of hydrochloric acid was further added to the aqueous medium to adjust the pH to 5.0 and obtain an aqueous medium 1.

Polymedzable Monomer Composition Preparation Step

Styrene 60.0 pts

C.I. pigment blue 15:3: 6.5 pts

These materials were placed in an attritor (Mitsui Miike) and dispersed for 5.0 hours at 220 rpm with zirconia beads 1.7 mm in diameter to prepare a pigment dispersion. The following materials were then added to this pigment dispersion.

Styrene: 20.0 pts n-butyl acrylate: 20.0 pts

Crosslinking agent (divinyl benzene): 0.3 pts

Saturated polyester resin: 5.0 pts (polycondensate of propylene oxide modified bisphenol A (2-mol adduct)) and terephthalic acid (mole ratio 10:12), glass transition temperature Tg=68° C., weight-average molecular weight Mw=10,000, molecular weight distribution 1 Mw/Mn=5.12)

Fischer-Tropsch wax (melting point 78° C.): 7.0 pts

This was maintained at 65° C., and uniformly dissolved and dispersed at 500 rpm with a T. K. Homomixer to prepare a polymerizable monomer composition.

Granulation Step

The temperature of the aqueous medium 1 was maintained at 70° C. and the rotation of the T. K. Homomixer (Tokushu Kika Kogyo Co. Ltd.) at 15,000 rpm as the polymerizable monomer composition was added to the aqueous medium 1, and 10.0 parts of t-butyl peroxypivalate were added as a polymerization initiator. This was then granulated for 10 minutes with the stirrer maintained at 15,000 rpm.

Polymerization and Distillation Step

Following the granulation step, the stirring device was replaced with a propeller stirring blade, and the mixture was stirred at 150 rpm as a polymerization reaction was performed by polymerizing for 5.0 hours with the temperature maintained at 70° C. and then raising the temperature to 85° C. and heating for 2.0 hours.

Next, the return pipe of the reactor was replaced with a cooling pipe, and the slurry was heated to 100° C. and distilled for 6 hours to remove unreacted polymerizable monomer and obtain a colorant particle dispersion.

Polymerization of Organic Silicon Compound 60.0 parts of ion exchange water were measured into a reaction vessel equipped with a stirrer and a thermometer, and the pH was adjusted to 4.0 with 10 mass % hydrochloric acid. This was heated under stirring, to a temperature of 40° C. 40.0 parts of the organosilicon compound methyl triethoxysilane were then added, and hydrolysis was performed under stirring for at least 2 hours. Completion of hydrolysis was confirmed visually when the oil and water formed one layer without separating, at which point the mixture was cooled to obtain a hydrolysis solution of the organic silicon compound.

The resulting colorant particle dispersion was cooled to 55° C., and 25.0 parts of the hydrolysis solution of the organosilicon compound were added to initiate polymerization of the organosilicon compound. This was maintained as is for 15 minutes, after which the pH was adjusted to 5.5 with 3.0% sodium hydrogen carbonate aqueous solution. Stirring was continued at 55° C. and maintained for 60 minutes, after which the pH was adjusted to 9.5 with 3.0% sodium hydrogen carbonate aqueous solution and the mixture was maintained for a further 240 minutes to obtain a toner particle dispersion.

Washing and Drying Step

After completion of the polymerization step, the toner particle dispersion was cooled, adjusted to a pH of not more than 1.5 by addition of hydrochloric acid, left for one hour under stirring, and then subjected to solid-liquid separation in a pressure filter to obtain a toner cake. This was re-slurried with ion exchange water to again obtain a dispersion, which was then subjected to solid-liquid separation in the same filter to obtain a toner cake.

The resulting toner cake was dried for 72 hours in a 40° C. thermostatic tank and classified to obtain a toner particle 1. The manufacturing conditions for the toner particle 1 are shown in Table 2.

Methods for Manufacturing Toner Particles 2 to 12

Toner particles 2 to 12 were obtained in the same way as the toner particle 1 except that the conditions were changed as shown in Table 2. The manufacturing conditions for the toner particles 2 to 12 are shown in Table 2.

Method for Manufacturing Comparative Toner Particle 1

A comparative toner particle 1 was obtained in the same way as the toner particle 1 except that polymerization of the organic silicon compound was changed as shown below. The manufacturing conditions for the comparative toner 1 are shown in Table 2.

Polymerization of Organic Silicon Compound 60.0 parts of ion exchange water were measured into a reaction vessel equipped with a stirrer and a thermometer, and the pH was adjusted to 4.0 with 10 mass % hydrochloric acid. This was heated under stirring, to a temperature of 40° C. 40.0 parts of the organosilicon compound methyl triethoxysilane were then added, and hydrolysis was performed under stirring for at least 2 hours. Completion of hydrolysis was confirmed visually when the oil and water formed one layer without separating, at which point the mixture was cooled to obtain a hydrolysis solution of the organosilicon compound.

The resulting colorant particle dispersion was cooled to 70° C., and the pH was adjusted to 9.5 with a 3.0% sodium hydrogen carbonate aqueous solution. Stirring was continued at 70° C. as 5.0 mass parts of colloidal silica (Snowtex ST-ZL: solids 40%) and 12.5 parts of the hydrolysis solution of the organosilicon compound were added to initiate polymerization of the organosilicon compound. This was then maintained as is for 300 minutes to obtain a toner particle dispersion.

Method for Manufacturing Comparative Toner Particle 2

A comparative toner particle 2 was obtained in the same way as the toner particle 1 except that the polymerization of the organosilicon compound was changed as shown below. The manufacturing conditions for the comparative toner particle 2 are shown in Table 2.

Polymerization of Organosilicon Compound

The colorant particle dispersion was dispersed in a mixed solvent of 1.0 mass part of polyvinyl alcohol dissolved in 20 mass parts of a mixed ethanol/water (mass ratio 1:1) solution, 20 parts of 3-(methacryloxy)propyl trimethoxysilane as a silicon compound were further dissolved, and this was stirred for a further 5 hours to swell and enclose the 3-(methacryloxy)propyl trimethoxysilane in the toner particles.

The temperature was then set at 70° C., and the pH was adjusted to 9.5 with 3.0% sodium hydrogen carbonate solution. This was stirred for 10 hours at room temperature to promote a sol-gel reaction on the toner particle surface and obtain a comparative toner particle 2.

Method for Manufacturing Comparative Toner Particle 3

A comparative toner particle 3 was obtain by not polymerizing the organosilicon compound in the manufacturing example of the toner particle 1. The manufacturing conditions for the comparative toner particle 3 are shown in Table 2.

TABLE 2

| | Type of organosilicon compound | Added amount | Holding time | Condensation reaction 1 pH | Condensation reaction 1 Time | Condensation reaction 2 pH | Condensation reaction 2 Time | Temperature | Remarks |
|---|---|---|---|---|---|---|---|---|---|
| Toner particle 1 manufacturing example | Methyl triethoxysilane | 10 | 0.25 | 5.5 | 1.0 | 9.5 | 4.0 | 55 | |
| Toner particle 2 manufacturing example | Methyl triethoxysilane | 12 | 0.25 | 5.5 | 1.0 | 9.5 | 4.0 | 55 | |

TABLE 2-continued

| | Type of organosilicon compound | Added amount | Holding time | Condensation reaction 1 pH | Condensation reaction 1 Time | Condensation reaction 2 pH | Condensation reaction 2 Time | Temperature | Remarks |
|---|---|---|---|---|---|---|---|---|---|
| Toner particle 3 manufacturing example | Methyl triethoxysilane | 16 | 0.25 | 5.5 | 1.0 | 9.5 | 4.0 | 55 | |
| Toner particle 4 manufacturing example | Methyl triethoxysilane | 10 | 0.25 | 7.0 | 1.5 | 9.5 | 3.5 | 55 | |
| Toner particle 5 manufacturing example | Methyl triethoxysilane | 12 | 0.25 | 7.0 | 1.5 | 9.5 | 3.5 | 55 | |
| Toner particle 6 manufacturing example | Methyl triethoxysilane | 16 | 0.25 | 7.0 | 1.5 | 9.5 | 3.5 | 55 | |
| Toner particle 7 manufacturing example | Methyl triethoxysilane | 12 | 0.25 | 7.0 | 3.5 | 9.5 | 1.5 | 55 | |
| Toner particle 8 manufacturing example | Methyl triethoxysilane | 16 | 0.25 | 4.0 | 1.0 | 9.5 | 3.5 | 55 | |
| Toner particle 9 manufacturing example | Methyl triethoxysilane | 16 | 0.25 | 4.0 | 2.0 | 9.5 | 3.0 | 55 | |
| Toner particle 10 manufacturing example | Methyl trimethoxysilane | 10 | 0.50 | 5.5 | 1.0 | 9.5 | 4.0 | 55 | |
| Toner particle 11 manufacturing example | Methyl triethoxysilane/Te triethoxysilane | 9.5/0.5 | 0.50 | 5.5 | 1.0 | 9.5 | 4.0 | 55 | |
| Toner particle 12 manufacturing example | Methyl triethoxysilane/ Vinyl triethoxysilane | 9.0/1.0 | 0.50 | 5.5 | 1.0 | 9.5 | 4.0 | 55 | |
| Comparative toner particle 1 manufacturing example | Methyl trimethoxysilane | 5 | 1.00 | 9.5 | 5.0 | — | — | 70 | Sol-gel silica included when adding organosilicon compound |
| Comparative toner particle 2 manufacturing example | 3-(methaeryloxy) propyl trimethoxysilane | 30 | 5.00 | 9.5 | 10.0 | — | — | 70 | |
| Comparative toner particle 3 manufacturing example | Not used | — | — | — | — | — | — | — | No organosilicon compound added |

Measuring Drive Torque

Next, measurement of the drive torque of the photosensitive drum 1 in this embodiment is explained.

In this measurement, the torque was measured with a photosensitive drum 1, a charging roller fixed so as to rotate with the photosensitive drum 1, a cleaning blade 3 and a seal sheet 4 mounted on the frame of a cleaning apparatus 2. A rotating jig with an attached torque measuring device for measuring the drive torque of the photosensitive drum 1 was also connected to measure the torque. Because this embodiment assumes the drive torque at the initial stage of cartridge use, the developing apparatus 7 was separated from the photosensitive drum 1 to exclude the effects of the developing apparatus 7.

To confirm the degree to which the lubricating effect of the lubricant was maintained, drive torque measurement was performed immediately after the start of drive and 60 seconds after the start of drive. The resulting drive torque values were used to establish a ranking system based on the following evaluation criteria. When evaluating the presence or absence of a lubricating effect in this embodiment, a rank of Δ or better for the drive torque 60 seconds after the start of drive was considered good. The torque measurement results for each of the tested toners are shown in Table 3.

Evaluation Standard

O: Drive torque not more than 1.8 kgf·cm

Δ: Drive torque 1.8 kgf·cm to 2.0 kgf·cm

X: Drive torque higher than 2.0 kgf·cm

In the results of Table 3, the torque tends to be lower 60 seconds after the start of drive when the Σw/L of the toner is small. It is thought that this promotes detachment of the protrusions e on the lubricant surface due to sliding of lubricant particles with each other and with the cut surface 26*a* as time elapses from the start of drive.

The torque also tends to be lower 60 seconds after the start of drive when the toner has a low P(D/w). It is thought that if the protrusions e on the lubricant surface have a low height h, the torque is increased because the contact area between the cleaning blade 3 and the photosensitive drum 1 is not reduced.

Explanation of Initial Low-Torque Operation

Next, the initial drive torque is reduced by supplying protrusions of the lubricant (toner having surface protrusions) to the cleaning nip N1 in the cleaning apparatus 2 of this embodiment. The mechanism for this is explained in detail using FIGS. 8A and 8B.

In FIG. 8A is a schematic view showing the condition near the cleaning nip N1 when lubricant that has been placed on the photosensitive drum is collected by the cleaning part 26. As discussed above, the lubricant comprises a toner base particle Tp and multiple protrusions e formed on the surface of the toner base particle Tp. The lubricant arrives at the cleaning part 26 by the lubricant coating method described above. When the lubricant arrives at the cleaning part 26, the cleaning part 26 and photosensitive drum 1 move relative to each other as the photosensitive drum 1 is driven, causing "convection" of the lubricant between the cleaning part 26 and the photosensitive drum 1 in the "adjacent region". This causes repeated rubbing between the lubricant and other lubricant particles or other members, so that the lubricant surface is subjected to "shear stress". At least some of the protrusions e formed on the lubricant surface transfer from the toner base particles Tp to the cleaning part 26 as a result. Some of the transferring protrusions e are then transported to the cleaning nip N1 under pressure from other protrusions e that have transported to the cleaning part 26, and the flat parts ep of these protrusions e attach to the side of the cleaning part 26. Protrusions e that have not been able to enter the cleaning nip N1 accumulate near the entrance to the cleaning nip N1, forming a deposition layer 23 of protrusions e.

Once the deposition layer 23 has formed, rotation of the photosensitive drum 1 in the direction of arrow A exerts force that pushes up the lubricant that has accumulated in the region formed by the photosensitive drum 1 and the cut surface 26*a* of the cleaning part 26 in the direction of the arrow B1, and the raised lubricant is then moved by gravity in the direction of the arrow B2. This causes the lubricant to circulate from arrow B1 to arrow B2 in the region 27. The lubricant rubs against the cut surface 26*a* and other lubricant particles as it circulates, so that the protrusions e formed on the lubricant surface become detached and move to the deposition layer 23 and the cut surface 26*a* of the cleaning part 26.

As shown in FIGS. 8A and 8B, with the lubricant used in this embodiment the protrusions e that transfer to the other lubricant particles, the cleaning part 26 and the deposition layer 23 have flat parts ep and curved parts ec, and in the case of those transferring protrusions e that enter the cleaning nip N1, the flat parts ep of the protrusions e attach to the side of the cleaning part 26. As a result, the curved parts ec of the protrusions e come into contact with the photosensitive drum 1, reducing the contact area between the cleaning blade 3 and the photosensitive drum 1. The cleaning blade 3 and the surface of the photosensitive drum 1 slide more easily as a result, allowing the drive torque of the photosensitive drum 1 to be reduced.

With a lubricant satisfying the conditions of Embodiments 4 to 15 in Table 3, the protrusions e formed on the surface of the toner base particles Tp are transported to the cut surface 26*a* of the cleaning part 26, where they can have a torque lowering effect on the drive of the photosensitive drum 1 until the developer from the developing apparatus 7 is developed on the peripheral surface of the photosensitive drum 1.

Although the toners described in Embodiments 4 to 15 are used as the lubricant in this embodiment, the toners described in Embodiments 4 to 15 have viscoelasticity equal to or greater than the toner T used as a developer. The toner used as a lubricant is placed on the photosensitive drum in this embodiment, but it could also be moved to the contact nip with the cleaning member when the photosensitive drum is slightly rotated or the like during transport of the process cartridge for example. In comparison with the toner used as a developer, therefore, because the toner used as a lubricant is expected to undergo rubbing and pressure it is sometimes exposed to a relatively unfavorable environment for deformation and adhesion, and this is the reason for using a toner having a viscoelasticity equal to or greater than the toner T used as a developer.

Considering the effects on the toner as a developer, moreover, a Ye toner is used as a lubricant in this embodiment, because Ye has little effect even when mixed with other colors.

TABLE 3

| | | | | | SEM image analysis results | Fluorescence X-ray analysis results | | Torque measurement | |
|---|---|---|---|---|---|---|---|---|---|
| | | | | | | | | Immediately after drive | After 60 s drive |
| | Toner | TEM image analysis results | | | | Silicon | Fixing rate | | |
| Test toner | particle used | P (D/w) | Σ (w/L) | H 80 nm | D 50 nm | wt % | % | kgf · cm | kgf · cm |
| Embodiment 4 | Toner particle 1 | 0.89 | 0.61 | 75 | 45 | 3.5 | 99 | ○ | ○ |
| Embodiment 5 | Toner particle 2 | 0.85 | 0.60 | 80 | 40 | 4.3 | 98 | ○ | ○ |
| Embodiment 6 | Toner Particle 3 | 0.82 | 0.64 | 85 | 45 | 5.3 | 97 | ○ | ○ |
| Embodiment 7 | Toner particle 4 | 0.79 | 0.33 | 80 | 30 | 3.6 | 99 | ○ | Δ |
| Embodiment 8 | Toner particle 5 | 0.77 | 0.40 | 85 | 35 | 4.4 | 98 | ○ | ○ |
| Embodiment 9 | Toner particle 6 | 0.77 | 0.42 | 90 | 40 | 5.4 | 95 | ○ | ○ |
| Embodiment 10 | Toner particle 7 | 0.90 | 0.30 | 90 | 25 | 4.4 | 91 | ○ | Δ |
| Embodiment 11 | Toner particle 8 | 0.95 | 0.83 | 75 | 60 | 5.4 | 84 | ○ | ○ |
| Embodiment 12 | Toner particle 9 | 0.85 | 0.91 | 70 | 65 | 5.3 | 94 | ○ | ○ |
| Embodiment 13 | Toner particle 10 | 0.90 | 0.62 | 80 | 40 | 3.4 | 94 | ○ | ○ |
| Embodiment 14 | Toner particle 11 | 0.87 | 0.45 | 90 | 40 | 3.5 | 92 | ○ | ○ |
| Embodiment 15 | Toner particle 12 | 0.95 | 0.85 | 70 | 55 | 3.4 | 99 | ○ | ○ |
| Embodiment 16 | Comparative toner particle 1 | 0.00 | 0.75 | 65 | 60 | 5.3 | 92 | X | X |
| Embodiment 17 | Comparative toner particle 2 | 0.20 | 0.20 | 45 | 30 | 3.5 | 78 | Δ | X |
| Embodiment 18 | Comparative toner particle 3 | 0.40 | 0.20 | 75 | 180 | 4.4 | 68 | Δ | X |
| Embodiment 19 | Comparative toner particle 3 | 0.00 | 0.30 | 60 | 80 | 4.2 | 85 | X | X |

Third Embodiment

Because the lubricant placement method is a feature of this embodiment, only the lubricant supply method is explained. Descriptions of other elements including the image formation apparatus are the same as in the Second Embodiment, and so the explanations are omitted.

Lubricant Placement Method

Figure 14A:
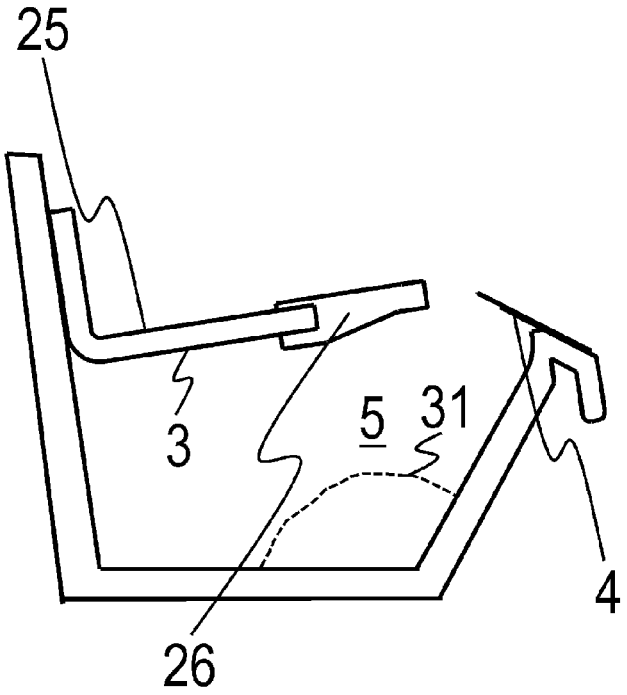
FIGS. 14A and 14B are schematic diagrams of a lubricant placement method in a third embodiment.
Figure 14B:
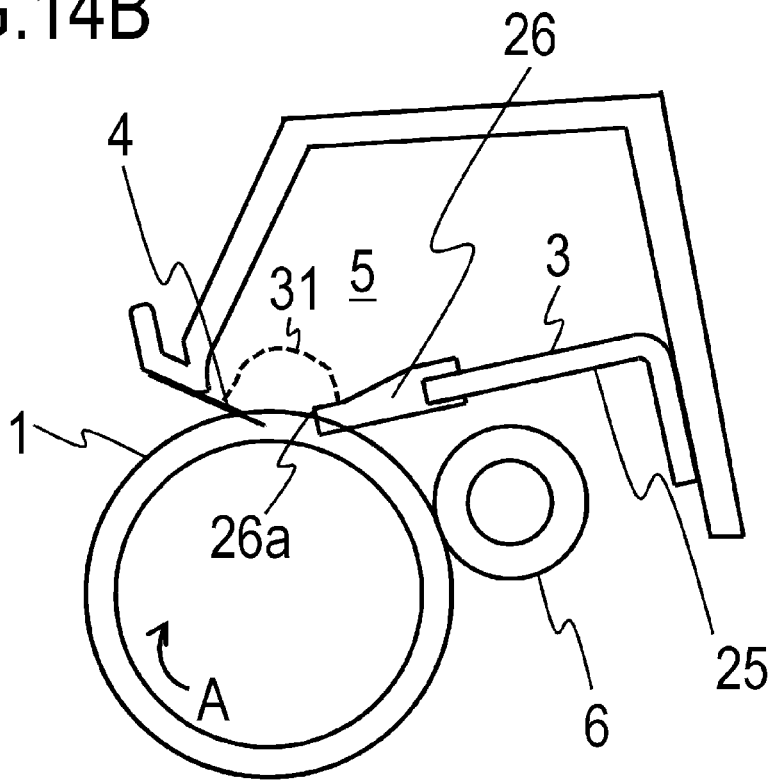

In this embodiment, the lubricant placement method that differs from Embodiment 2 is explained using FIGS. 14A and 14B. It is a feature of this embodiment that the lubricant 31 is stored in advance in the waste toner storage container 5.

Like the toner T, the lubricant 31 is a composite particle having a first particle containing a base particle and an organosilicon polymer on the surface of the base particle. When the apparatus is driven, it is transported and supplied by the rotation of the photosensitive drum 1 to the adjacent region 27 adjoining the contact area between the photosensitive drum 1 and the cleaning blade 3 on the upstream side in the rotation direction of the photosensitive drum 1. A reduction in the drive torque of the photosensitive drum 1 can then be achieved through the lubricating function of the protrusions transferring to this contact area from the base particle surface, which is similar to the lubricating function of the protrusions e in the toner T.

The waste toner storage container 5 shown in FIG. 14B is shown upside-down In FIG. 14A. The lubricant 31 is stored in the waste toner storage container 5 as shown by the dotted line in the waste toner storage container 5 in FIG. 14A. When the photosensitive drum 1 is assembled, the position of the waste toner storage container 5 is changed so that the lubricant 31 is supplied to the photosensitive drum 1 between the seal sheet 4 and the cleaning blade 3. A torque reduction effect is thus obtained as explained in the Second Embodiment (lubricant placement method).

Fourth Embodiment

Because the lubricant placement method is also a feature of this embodiment, only the lubricant supply method is explained. Descriptions of other elements including the image formation apparatus are the same as in the Second Embodiment, and so the explanations are omitted.

Lubricant Placement Method

Figure 15:
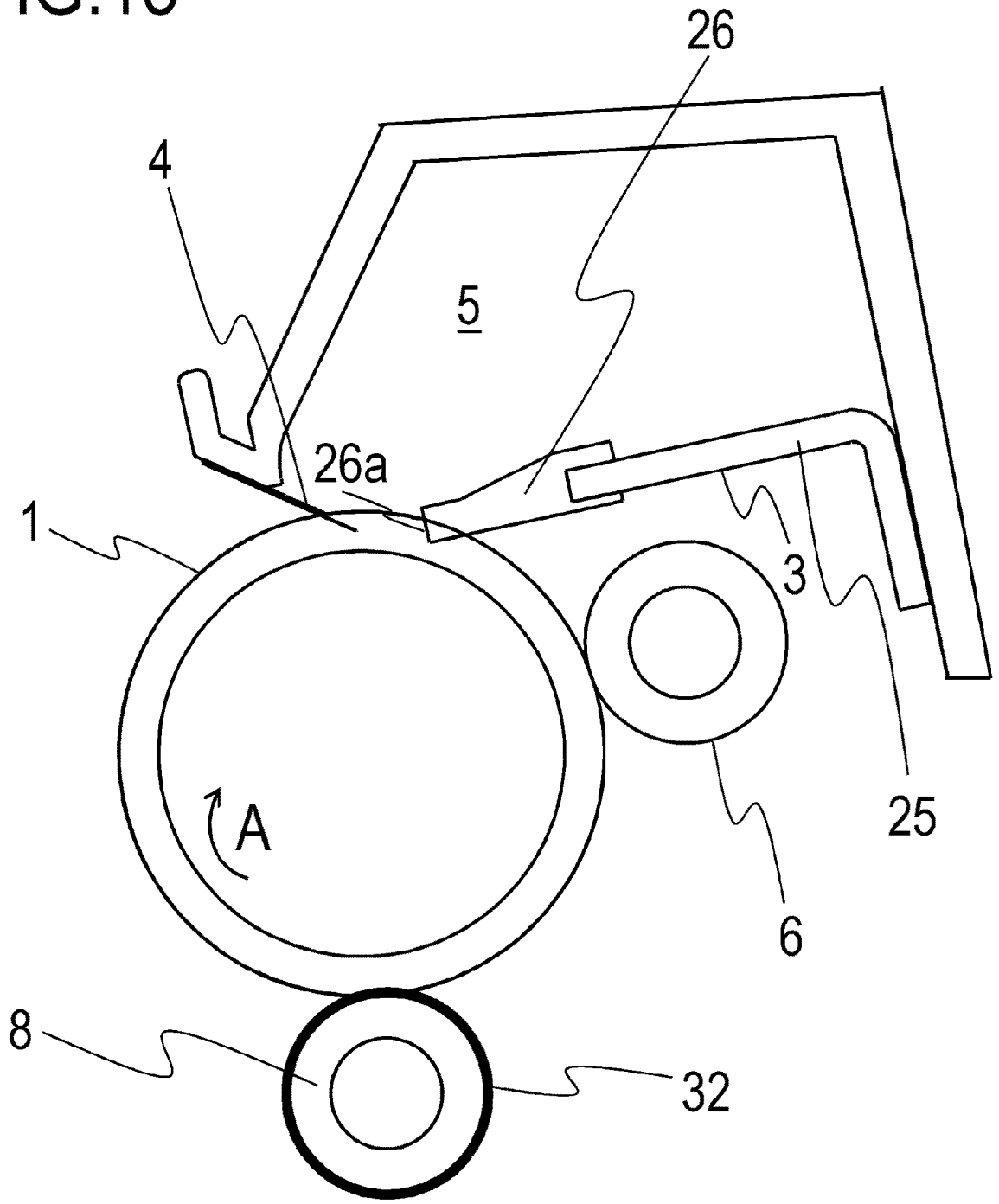
FIG. 15 is a schematic diagram of a lubricant placement method in a fourth embodiment.

In this embodiment, the lubricant placement method that differs from Embodiment 2 is explained using FIG. 15. It is a feature of this embodiment that the lubricant 32 is placed (coated) in advance on the surface of the developing roller 8.

Like the toner T, the lubricant 32 is a composite particle having a first particle containing a base particle and an organosilicon polymer on the surface of the base particle. When the apparatus is driven, it is transported and supplied by the rotation of the developing roller 8 and the photosensitive drum 1 to the adjacent region 27 adjoining the contact area between the photosensitive drum 1 and the cleaning blade 3 on the upstream side in the rotation direction of the photosensitive drum 1. A reduction in the drive torque of the photosensitive drum 1 can then be achieved through the lubricating function of the protrusions transferring to this contact area from the base particle surface, which is similar to the lubricating function of the protrusions e in the toner T.

The toner T may also be used as the lubricant 32.

FIG. 15 shows the lubricant 32 placed on the surface of the developing roller 8. When the photosensitive drum 1 and the developing roller 8 are in contact and the developing roller 8 is rotating, voltage is applied so that the photosensitive drum 1 has a positive polarity relative to the developing roller 8, and the lubricant 32 is developed on the surface of the photosensitive drum 1.

The lubricant is thus placed as in FIG. 13C in Embodiment 2, and a torque reduction effect can be obtained as a result.

For the lubricant 32 placed on the developing roller 8 to be supplied to the photosensitive drum 1 it is necessary that the photosensitive drum 1 and developing roller 8 be in contact, but they may be in contact either constantly or only during development. Moreover, the rotation direction of the developing roller 8 may be either the forward rotation direction or reverse rotation direction relative to the rotation direction of the photosensitive drum 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-094056, filed on May 17, 2019, and No. 2020-005444, filed on Jan. 16, 2020, which are hereby incorporated by reference herein in its entirety.

What is claimed is:

1. A process cartridge for use in an image forming apparatus, comprising the following:

a rotatable image bearing member having a peripheral surface whereon a latent image is formed, a developing apparatus that supplies a developer to the image bearing member to develop the latent image, a cleaning member that comes into contact with the peripheral surface and removes the developer from the peripheral surface, and a seal member that comes into contact with the peripheral surface at a contact part between the seal member and the peripheral surface on an upstream side of the cleaning member in the rotation direction of the image bearing member, and that allows developer to move from an upstream side of the contact part to a downstream side of the contact part in the rotation direction while regulating movement of the developer from the downstream side of the contact part to the upstream side of the contact part in the rotation direction;

wherein the developer includes a toner having a toner particle containing a toner base particle and an organosilicon polymer on the toner base particle surface, the organosilicon polymer has a structure represented by formula (1) below, and the organosilicon polymer forms protrusions on the toner base particle surface, and wherein either (i) the work function of the seal member, is greater than the work function of the developer when the developer has a negative charging polarity, and is smaller than the work function of the developer when the developer has a positive charging polarity, or (ii) the absolute value of the difference between the work function of the seal member and the work function of the developer is within a predetermined range;

$$R—SiO_{3/2} \quad (1)$$

in the formula, R is a $C_{1-6}$ alkyl group or phenyl group.

2. The process cartridge according to claim 1, wherein the predetermined range in (ii) above is less than 0.15 eV.

3. The process cartridge according to claim 1, wherein the seal member comprises either (i) a composite in which a PTFE tape is affixed to a sheet member made of PET, or (ii) a sheet member made of PET.

4. The process cartridge according to claim 1, further comprising:

a frame to which the cleaning member is fixed;

wherein the cleaning member having an elastic body and a support for supporting the elastic body, wherein one end of the elastic body is fixed to the support, and a free end as the other end comes into contact with the peripheral surface, wherein one end of the support is fixed to the frame, and a free end as the other end is fixed to the elastic body, and wherein the direction extending from the one end of the support toward the other end of the elastic body is the opposite direction from the direction of rotation of the image bearing member at the part where the other end comes into contact with the peripheral surface.

5. The process cartridge according to claim 4, wherein the elastic body has a tip surface at the other end of the elastic body, and a lower surface facing the peripheral surface adjacent to the tip surface on the other side of the tip ridge, and wherein when the process cartridge is mounted on the main body of an image forming apparatus, at least part of the tip surface is either horizontal or at a positive elevation to the horizontal plane so that the height relative to the horizontal plane increases with distance from the peripheral surface.

6. The process cartridge according to claim 5, wherein the angle of at least part of the tip surface relative to the horizontal plane is greater than the angle of repose of the developer.

7. An image forming apparatus comprising:

a main body; and a process cartridge comprising the following:

a rotatable image bearing member having a peripheral surface whereon a latent image is formed, a developing apparatus that supplies a developer to the image bearing member to develop the latent image, a cleaning member that comes into contact with the peripheral surface and removes the developer from the peripheral surface, and a seal member that comes into contact with the peripheral surface at a contact part between the seal member and the peripheral surface on an upstream side of the cleaning member in the rotation direction of the image bearing member, and that allows developer to move from an upstream side of the contact part to a downstream side of the contact part in the rotation direction while regulating movement of the developer from the downstream side of the contact part to the upstream side of the contact part in the rotation direction;

wherein the developer includes a toner having a toner particle containing a toner base particle and an organosilicon polymer on the toner base particle surface, the organosilicon polymer has a structure represented by formula (1) below, and the organosilicon polymer forms protrusions on the toner base particle surface, and wherein either (i) the work function of the seal member, is greater than the work function of the developer when the developer has a negative charging polarity, and is smaller than the work function of the developer when the developer has a positive charging polarity, or (ii) the absolute value of the difference between the work function of the seal member and the work function of the developer is within a predetermined range;

$$R—SiO_{3/2} \quad (1)$$

in the formula, R is a C 1-6 alkyl group or phenyl group, the process cartridge being detachable from the main body.

8. An image forming apparatus for forming images on a recording material, comprising:

a rotatable image bearing member having a peripheral surface whereon a latent image is formed, a developing apparatus that supplies a developer to the image bearing member to develop the latent image, a cleaning member that comes into contact with the peripheral surface and removes the developer from the peripheral surface, a seal member that comes into contact with the peripheral surface at a contact part between the seal member and the peripheral surface on an upstream side of the cleaning member in the rotation direction of the image bearing member, and that allows developer to move from an upstream side of the contact part to a downstream side of the contact part in the rotation direction while regulating movement of the developer from the downstream side of the contact part to the upstream side of the contact part in the rotation direction, and an voltage application means for applying voltage to the seal member, wherein the developer includes a toner having a toner particle containing a toner base particle and an organosilicon polymer on the toner base particle surface, the organosilicon polymer has a structure represented by formula (1) below, and the organosilicon polymer forms protrusions on the toner base particle surface, and wherein the seal member is a member having electrical conductivity, and wherein the voltage application means applies voltage having a polarity opposite to the normal charging polarity of the toner;

$$R—SiO_{3/2} \quad (1)$$

in the formula, R is a $C_{1-6}$ alkyl group or phenyl group.

9. The image forming apparatus according to claim 8, further comprising:

a frame to which the cleaning member is fixed;

wherein the cleaning member has an elastic body and a support for supporting the elastic body, and wherein one end of the elastic body is fixed to the support, and an free end as the other end comes into contact with the peripheral surface, wherein one end of the support is fixed to the frame, and a free end as the other end is fixed to the elastic body, and wherein the direction extending from the one end of the support toward the other end of the elastic body is the opposite direction from the direction of rotation of the image bearing member at the part where the other end comes into contact with the peripheral surface.

10. The image forming apparatus according to claim 9,
wherein the elastic body has a tip surface at the other end of the elastic body, and a lower surface facing the peripheral surface adjacent to the tip surface on the other side of the tip ridge, and
wherein at least part of the tip surface is either horizontal or at a positive elevation to the horizontal plane so that the height relative to the horizontal plane increases with distance from the peripheral surface.

11. The image forming apparatus according to claim 10,
wherein the angle of at least part of the tip surface relative to the horizontal plane is greater than the angle of repose of the developer.

12. A cleaning apparatus comprising:
a frame,
an image bearing member that is rotatably supported by the frame and carries a developer image consisting of a developer, and
a cleaning member that is provided on the frame and that cleans developer remaining on the surface of the image bearing member after the developer image has been transferred from the image bearing member, and that has a contact portion capable of coming into contact with the surface of the image bearing member,
wherein during use, an intervening particle is present in an adjacent region, which is located on an upstream side of a contact area between the contact portion and the image bearing member, and which is adjacent to the contact area, in the rotation direction of the image bearing member,
wherein the intervening particle is a composite particle having a first particle which contains a base particle and an organosilicon polymer on the surface of the base particle, and
wherein the organosilicon polymer has a structure represented by formula (1) below, and
wherein the organosilicon polymer forms protrusions on the toner base particle surface, and
wherein, in a flat image obtained by observing a cross-section of the composite particle with a scanning transmission electron microscope STEM, drawing a line along the circumference of the base particle surface, and converting based on this line along the circumference, and
assuming that the length of the line along the circumference for a segment where a protrusion and the toner base particle form a continuous interface is taken as a protrusion width w, the maximum length of a protrusion in the direction normal to the protrusion width w is taken as a protrusion diameter d, and the length, in the line segment that forms the protrusion diameter d, from the peak of the protrusion to the line along the circumference is taken as a protrusion height h,
the numerical proportion P(d/w), in protrusions having a protrusion height h from 40 nm to 300 nm, of protrusions having a ratio d/w of protrusion diameter d to protrusion width w from 0.33 to 0.80 is at least 70 number %, and
wherein the protrusion is transported from the surface of the base particle to the contact area by the rotation of the image bearing member;

$$R—SiO_{3/2} \quad (1)$$

in the formula, R is a $C_{1-6}$ alkyl group or phenyl group.

13. The cleaning apparatus according to claim 12,
wherein in the observation of the composite particle using a scanning transmission electron microscope STEM, $\Sigma w/L$ is from 0.30 to 0.90 where the width of the flat image is taken as a circumference length L and the sum of the protrusion widths w of protrusions having a protrusion height h from 40 nm to 300 nm of the protrusions of the organosilicon polymer present in the flat image is taken as $\Sigma w$.

14. The cleaning apparatus according to claim 12,
wherein the fixing rate of the organosilicon polymer in the composite particle is at least 80 mass %.

15. The cleaning apparatus according to claim 12,
wherein the intervening particle is coated in advance on the peripheral surface of the image bearing member, and the intervening particle is transported to the adjacent region by the rotation of the image bearing member.

16. The cleaning apparatus according to claim 12,
wherein the intervening particle is contained within the frame, and the intervening particle is transported to the adjacent region by the rotation of the image bearing member.

17. The cleaning apparatus according to claim 12,
wherein the intervening particle has viscoelasticity equal to or greater than that of the developer used to develop the developer image.

18. The cleaning apparatus according to claim 12,
wherein the intervening particle is a developer, and
wherein the developer has a toner particle containing a toner base particle and an organosilicon polymer on the surface of the toner base particle.

19. The cleaning apparatus according to claim 12,
wherein h80 is at least 65 nm where h80 is the protrusion height corresponding to 80 number % for cumulation of the protrusion height h from the small side when a cumulative distribution of the protrusion height h is constructed for the protrusions having a protrusion height h from 40 nm to 300 nm.

20. The cleaning apparatus according to claim 12,
wherein R is a $C_{1-6}$ alkyl group.

21. A process cartridge comprising:
a frame,
an image bearing member that is rotatably supported by the frame and carries a developer image consisting of a developer,
a developer carrying member that supplies developer to the image bearing member so that a latent image formed on the image bearing member is developed into the developer image, and
a cleaning member provided on the frame that cleans developer remaining on the surface of the image bearing member after the developer image has been transferred from the image bearing member, and that has a contact portion capable of coming into contact with the surface of the image bearing member,
wherein during use, an intervening particle is present in an adjacent region, which is located on an upstream side of a contact area between the contact portion and the image bearing member, and which is adjacent to the contact area, in the rotation direction of the image bearing member, and
wherein the intervening particle is a composite particle having a first particle which contains a base particle and an organosilicon polymer on the surface of the base particle, and
wherein the organosilicon polymer has a structure represented by formula (1) below, and
wherein the organosilicon polymer forms protrusions on the toner base particle surface, and wherein, in a flat image obtained by observing a cross-section of the composite particle with a scanning transmission electron microscope STEM, drawing a line along the circumference of the base particle surface and converting based on this line along the circumference, and assuming that the length of the line along the circumference for a segment where a protrusion and the toner base particle from a continuous interface is taken as a protrusion width w, the maximum length of a protrusion in the direction normal to the protrusion width w is taken as a protrusion diameter d, and the length, in the line segment that forms the protrusion diameter d, from the peak of the protrusion to the line along the circumference is taken as a protrusion height h, and wherein, the numerical proportion P (d/w), in protrusions having a protrusion height h from 40 nm to 300 nm, of protrusions having a ratio d/w of protrusion diameter d to protrusion width w from 0.33 to 0.80 is at least 70 number %, and wherein the protrusion is transported from the surface of the base particle to the contact area by the rotation of the image bearing member rotates;

$$R—SiO_{3/2} \quad (1)$$

in the formula, R is a $C_{1-6}$ alkyl group or phenyl group.

22. The process cartridge according to claim 21, wherein in the observation of the composite particle using a scanning transmission electron microscope STEM, Σw/L is from 0.30 to 0.90 where the width of the flat image is taken as a circumference length L and the sum of the protrusion widths w of protrusions having a protrusion height h from 40 nm to 300 nm out of the protrusions of the organosilicon polymer present in the flat image is taken as Σw.

23. The process cartridge according to claim 21, wherein the fixing rate of the organic silicon polymer in the composite particle is at least 80 mass %.

24. The process cartridge according to claim 21, wherein the intervening particle is coated in advance on the peripheral surface of the image bearing member, and the intervening particle is transported to the adjacent region by the rotation of the image bearing member.

25. The process cartridge according to claim 21, wherein the intervening particle is contained within the frame, and the intervening particle is transported to the adjacent region by the rotation of the image bearing member.

26. The process cartridge according to claim 21, wherein the intervening particle has viscoelasticity equal to or greater than that of the developer used to develop the developer image.

27. The process cartridge according to claim 21, wherein the intervening particle is a developer, and the developer has a toner particle containing a toner base particle and an organosilicon polymer on the surface of the toner base particle.

28. The process cartridge according to claim 21, wherein h80 is at least 65 nm where h80 is the protrusion height corresponding to 80 number % for cumulation of the protrusion height h from the small side when a cumulative distribution of the protrusion heights h is constructed for the protrusions having a protrusion height h from 40 nm to 300 nm.

29. The process cartridge according to claim 21, wherein R is a $C_{1-6}$ alkyl group.

30. An image forming apparatus comprising:

a frame, an image bearing member that is rotatably supported by the frame and carries a developer image consisting of a developer, and a cleaning member that is provided on the frame and that cleans developer remaining on the surface of the image bearing member after the developer image has been transferred from the image bearing member, and that has a contact portion capable of coming into contact with the surface of the image bearing member, wherein during use, an intervening particle is present in an adjacent region, which is located on an upstream side of a contact area between the contact portion and the image bearing member, and which is adjacent to the contact area, in the rotation direction of the image bearing member, wherein the intervening particle is a composite particle having a first particle which contains a base particle and an organosilicon polymer on the surface of the base particle, and wherein the organosilicon polymer has a structure represented by formula (1) below, and wherein the organosilicon polymer forms protrusions on the toner base particle surface, and wherein, in a flat image obtained by observing a cross-section of the composite particle with a scanning transmission electron microscope STEM, drawing a line along the circumference of the base particle surface and converting based on this line along the circumference, and assuming that the length of the line along the circumference for a segment where a protrusion and the toner base particle from a continuous interface is taken as a protrusion width w, the maximum length of a protrusion in the direction normal to the protrusion width w is taken as a protrusion diameter d, and the length, in the line segment that forms the protrusion diameter d, from the peak of the protrusion to the line along the circumference is taken as a protrusion height h, the numerical proportion P (d/w), in protrusions having a protrusion height h from 40 nm to 300 nm, of protrusions having a ratio d/w of protrusion diameter d to protrusion width w from 0.33 to 0.80 is at least 70 number %, and wherein the protrusion is transported from the surface of the base particle to the contact area by the rotation of the image bearing member rotates;

$$R—SiO_{3/2} \quad (1)$$

in the formula, R is a $C_{1-6}$ alkyl group or phenyl group.

31. An image forming apparatus comprising:

a frame, an image bearing member that is rotatably supported by the frame and carries a developer image consisting of a developer, a developer carrying member that supplies developer to the image bearing member so that a latent image formed on the image bearing member is developed into the developer image, and a cleaning member provided on the frame that cleans developer remaining on the surface of the image bearing member after the developer image has been transferred from the image bearing member, and that has a contact portion capable of coming into contact with the surface of the image bearing member, wherein during use, an intervening particle is present in an adjacent region, which is located on an upstream side of a contact area between the contact portion and the image bearing member, and which is adjacent to the contact area, in the rotation direction of the image bearing member, wherein the intervening particle is a composite particle having a first particle which contains a base particle and an organosilicon polymer on the surface of the base particle, and wherein the organosilicon polymer has a structure represented by formula (1) below, and wherein the organosilicon polymer forms protrusions on the toner base particle surface, and wherein, in a flat image obtained by observing a cross-section of the composite particle with a scanning transmission electron microscope STEM, drawing a line along the circumference of the base particle surface, and converting based on this line along the circumference, and assuming that the length of the line along the circumference for a segment where a protrusion and the toner base particle from a continuous interface is taken as a protrusion width w, the maximum length of a protrusion in the direction normal to the protrusion width w is taken as a protrusion diameter d, and the length, in the line segment that forms the protrusion diameter, from the peak of the protrusion to the line along the circumference is taken as a protrusion height h, the numerical proportion P(d/W), in protrusions having a protrusion height h from 40 nm to 300 nm, of protrusions having a ratio d/w of protrusion diameter d to protrusion width w from 0.33 to 0.80 is at least 70 number %, and wherein the protrusion is transported from the surface of the base particle to the contact area by the rotation of the image bearing member;

$$R—SiO_{3/2} \quad (1)$$

in the formula, R is a $C_{1-6}$ alkyl group or phenyl group.

32. The image forming apparatus according to claim 31, wherein in the observation of the composite particle using a scanning transmission electron microscope STEM, Σw/L is from 0.30 to 0.90 where the width of the flat image is taken as a circumference length L and the sum of the protrusion widths w of protrusions having a protrusion height h from 40 nm to 300 nm of the protrusions of the organosilicon polymer present in the flat image is taken as Σw.

33. The image forming apparatus according to claim 31, wherein the fixing rate of the organosilicon polymer in the composite particle is at least 80 mass %.

34. The image forming apparatus according to claim 31, wherein the intervening particle is coated in advance on the peripheral surface of the image bearing member, and the intervening particle is transported to the adjacent region by the rotation of the image bearing member.

35. The image forming apparatus according to claim 31, wherein the intervening particle is contained within the frame, and the intervening particle is transported to the adjacent region by the rotation of the image bearing member.

36. The image forming apparatus according to claim 31, wherein the intervening particle has viscoelasticity equal to or greater than that of the developer used to develop the developer image.

37. The image forming apparatus according to claim 31, wherein the intervening particle is a developer, and wherein the developer has a toner particle containing a toner base particle and an organic silicon polymer on the surface of the toner base particle.

38. The image forming apparatus according to claim 31, wherein h80 is at least 65 mm where h80 is the protrusion height corresponding to 80 number % for cumulation of the protrusion height h from the small side when a cumulative distribution of the protrusion heights h is constructed for the protrusions having a protrusion height h from 40 nm to 300 nm.

39. The image forming apparatus according to claim 31, wherein R is a $C_{1-6}$ alkyl group.

* * * * *